US005959641A

United States Patent [19]

Yokoi

[11] Patent Number: 5,959,641

[45] **Date of Patent: *Sep. 28, 1999**

[54] INK-JET RECORDING APPARATUS AND METHOD UTILIZING PROCESSING LIQUID TO IMPROVE INK RECORDING

[75] Inventor: Katsuyuki Yokoi, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/520,562

[22] Filed: Aug. 28, 1995

[30] Foreign Application Priority Data

Sep. 2, 1994 [JP] Japan ..... 6-210219

[51] Int. Cl.[6] ..... B41J 2/015

[52] U.S. Cl. ..... 347/21; 347/98

[58] Field of Search ..... 347/15, 20, 21, 347/43, 98, 48, 95, 96, 100, 101

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,538,160 | 8/1985 | Uchiyama | 346/140 R |
| 4,558,333 | 12/1985 | Sugitani et al. . | |
| 4,608,577 | 8/1986 | Hori . | |
| 4,614,953 | 9/1986 | Lapeyre | 346/140 R |
| 4,630,086 | 12/1986 | Yoshimura | 346/140 R |
| 4,723,129 | 2/1988 | Endo et al. . | |
| 4,740,796 | 4/1988 | Endo et al. . | |
| 4,746,935 | 5/1988 | Allen | 346/140 R |
| 5,198,833 | 3/1993 | Kubota | 346/1.1 |
| 5,320,668 | 6/1994 | Shields et al. | 106/20 R |
| 5,488,402 | 1/1996 | Shields et al. | 347/96 |
| 5,555,008 | 9/1996 | Stoffel et al. | 347/100 |
| 5,635,969 | 6/1997 | Allen | 347/96 |

FOREIGN PATENT DOCUMENTS

| | | |
|---|---|---|
| 54-056847 | 5/1979 | Japan . |
| 55-150396 | 11/1980 | Japan . |
| 58-128862 | 8/1983 | Japan . |
| 59-123670 | 7/1984 | Japan . |
| 59-138461 | 8/1984 | Japan . |
| 60-071260 | 4/1985 | Japan . |
| 64-063185 | 3/1989 | Japan . |

*Primary Examiner*—Safet Metjahic
*Assistant Examiner*—John Chizmar
*Attorney, Agent, or Firm*—Fitzpatrick, Cella, Harper & Scinto

[57] ABSTRACT

In an ink-jet recording apparatus having two recording modes having different resolutions in recording, high density is realized in each of the recording modes in an excellent state. In a high-resolution recording mode, a colorless processing liquid to cause ink and its color material to be insoluble or to agglomerate is discharged, and the processing liquid and the ink are mixed on a recording medium. Thus, the ink becomes insoluble and therefore does not penetrate deeply into the recording medium, so that dots formed by the ink have a smaller diameter. As a result, high-resolution recording with the small-diameter dots can be realized. In a low-resolution recording mode, the diameter of dots formed by the ink without using the processing liquid is larger than in the foregoing case. Accordingly, dots can be densely arranged in the two modes, so that high density can be realized in an excellent state.

23 Claims, 20 Drawing Sheets

[A-A]

INK-JET RECORDING APPARATUS AND METHOD UTILIZING PROCESSING LIQUID TO IMPROVE INK RECORDING

BACKGROUND OF THE INVENTION

1. Field of the Invention

This invention relates to an ink-jet recording apparatus and an ink-jet recording method.

2. Description of the Related Art

It is known that in apparatuses of this kind, recording is performed by forming dots on a recording medium. FIG. 10 is a schematic diagram illustrating the configuration of a conventional apparatus of this kind.

In FIG. 10, an ink-jet recording head 1 forms dots on a recording medium by discharging ink. A carriage 2 detachably mounts the ink-jet recording head 1 and performs scanning in a main scanning direction. The scanning of the carriage 2 is realized by the driving force of a CR (carriage) motor 3 which comprises a pulse motor. That is, the driving force of the CR motor 3 is transmitted to the carriage 2 via a driving belt 4, and the scanning of the carriage 2 is guided by two carriage shafts 5 which slidably support the carriage 2.

A conveying roller 6 conveys the recording medium in a sub-scanning direction, and is driven by an LF (line-feed) motor 7.

A control circuit 8 controls the ink-jet recording head 1, the CR motor 3, the LF motor 7 and the like based on a recording signal. A cable 9 transmits a control signal from the control circuit 8 to the ink-jet recording head 1.

FIG. 11 is a block diagram illustrating principally the configuration of the control circuit 8. In FIG. 11, a CPU (central processing unit) 13, comprising a microprocessor, exchanges signals with a host computer 14 via an interface 15, and controls the recording operation of the apparatus shown in FIG. 10 based on recording data stored in a program memory 16, comprising a ROM (read-only memory), or recording data transmitted from the host computer 14 and stored in a buffer memory 17, comprising a RAM (random access memory). That is, the CPU 13 controls the CR motor 3 and the LF motor 7 via motor drivers 22 and 23, respectively, and also controls the discharging driving of the ink-jet recording head 1 via a head driver 21 based on the recording data stored in the RAM 17. An operation panel 18 is provided at a portion of the apparatus shown in FIG. 10. The user can confirm the recording state of the apparatus and input various kinds of commands through the operation panel 18. A sheet sensor 19 detects if the recording medium is present in a recording region by the ink-jet recording head 1.

FIG. 12 is a flowchart illustrating an example of recording control in the above-described conventional apparatus.

When recording data has been transmitted from the host computer 14, the CPU 13 develops the received data into data having the form of ink discharge by the ink-jet recording head 1, and stores the obtained data in a buffer memory for one line in the RAM 17 (step S1201). Then, the ink-jet recording head 1 mounted on the carriage 2 is moved to perform scanning by driving the CR motor 3. Recording is performed by forming dots by discharging ink from the moving ink-jet recording head 1 onto the recording medium (steps S1202 and S1203).

FIG. 13 illustrates a method for forming recording dots at that time.

The ink-jet recording head 1 includes discharging ports, whose number equals H, for discharging ink arranged at a pitch $P_D$. The diameter of a dot formed by ink discharged from each of the discharging ports is set to an optimum size to cover the pitch $P_D$. The timing of ink discharge from the ink-jet recording head 1 while performing main scanning is provided so as to be synchronized with driving pulses for driving the CR motor 3. That is, for example, the diameter of a pulley (not shown in FIG. 10) is set so that the moving distance of the ink-jet recording head 1 by a one-pulse drive of the CR motor 3 equals an integer multiple (four times in the case of FIG. 13) of the pitch $P_D$, and the ink is discharged at a predetermined time interval $t_E$ set by a timer 20 during consecutive motor driving pulses. That is, the time interval $t_E$ is calculated so that the pitch of recorded dots formed from the carriage speed of the CR motor 3 equals $P_D$. When ink discharge based on the recording data for one line stored in the line buffer has been completed, the recording medium is conveyed, as shown in FIG. 14, by a distance $L_n$, which equals $H \times P_D$, in the sub-scanning direction by the conveying roller 6 by driving the LF motor 7 (step S1205). Then, the carriage 2 is returned to the start position, and the recording operation for one line is completed (step S1206). When the received data still remains, the processing of steps S1201–S1206 is repeated.

Some conventional apparatuses have a low-resolution mode called a draft mode in addition to the above-described recording mode. A recording mode can be selected, for example, through the operation panel 18. In the low-resolution mode, recording is performed while doubling the pitch $P_D$of dots formed in the above-described ordinary recording mode. FIGS. 15 and 16 illustrate a method for forming dots in the main scanning direction and in the sub-scanning direction in this mode.

In FIGS. 15 and 16, the position of a black dot corresponds to a position where a dot is formed by discharging ink in the draft mode, and the position of a black dot corresponds to a position where a dot is formed in the above-described ordinary printing mode, while a dot is not formed, i.e., recording is not performed, in the low-resolution mode.

As shown in FIG. 15, also in the low-resolution mode, dots can be formed in the main scanning direction with the same time interval $t_E$ as in the ordinary printing mode. Hence, the carriage speed can be increased by reducing the interval $t_{Md}$ of driving pulses for the CR motor 3 to ½ of the interval $t_M$ of driving pulses in the ordinary recording mode. Accordingly, the low-resolution mode is used as a mode to shorten the recording time.

In Japanese Patent Laid-Open Application (Kokai) No. 64-63185 (1989), a technique of supplying colorless ink, which causes a dye to become insoluble, onto a material, on which printing is to be performed, using an ink-jet print head is disclosed.

In Japanese Patent Laid-Open Application (Kokai) No. 55-150396 (1980), a technique of supplying a hydration-resistant agent, which forms a pool with a dye, after performing ink-jet printing of water dye ink is disclosed.

In Japanese Patent Laid-Open Application (Kokai) No. 58-128862 (1983), an ink-jet printing method, in which the position of an image to be printed is previously identified, and printing is performed by superposing printing ink and processing ink, is disclosed. In this method, the image is depicted by the processing ink before depicting the image by the printing ink, or the processing ink is superposed on the previously depicted printing ink, or the printing ink is superposed on the previously depicted processing ink followed by superposing the processing ink thereon.

When forming dots on a recording medium by discharging ink in the draft mode, as is apparent from FIG. 15, the size of each dot recorded in the low-resolution mode generally corresponds to the dot pitch $P_D$ in the ordinary recording mode. Hence, if dots are formed with a pitch of $P_D \times 2$, a space is present between adjacent dots, and therefore an increase in the density corresponding to the number of formed dots cannot be obtained.

In order to solve such a problem, a method of increasing the size of formed dots can be considered. In this method, however, problems arise in the ordinary recording mode in which, for example, spaces in recorded characters tend to be connected because the amount of discharged ink is too great. Accordingly, in conventional apparatuses, the above-described problem remains unsolved.

SUMMARY OF THE INVENTION

The present invention has been made in consideration of the above-described problems.

It is an object of the present invention to provide an ink-jet recording apparatus having two recording modes having different resolutions which can particularly realize high density in each of the recording modes, and therefore can perform high-quality recording.

According to one aspect of the present invention, which achieves the above-described object, an ink-jet recording apparatus performs recording on a recording medium using an ink jet recording head for discharging ink and a liquid jet head for discharging a processing liquid for causing a coloring material in the ink discharged from the ink jet recording head to be insoluble or to agglomerate, and comprises low-resolution-mode control means for effecting recording by controlling ink discharge from the ink jet recording head to form a plurality of dots on the recording medium by ink discharged from the recording head and controlling feeding of the recording medium, and high-resolution-mode control means for effecting recording by controlling ink discharge from the ink jet recording head and processing liquid discharge from the liquid jet head to form a plurality of dots by mixing the ink and the processing liquid discharged from the ink jet recording head and the liquid jet head, respectively, on the recording medium, and controlling feeding of the recording medium.

According to another aspect, the present invention relates to an ink-jet recording method for performing recording on a recording medium using an ink jet recording head for discharging ink and a liquid jet head for discharging a processing liquid for causing a coloring material in the ink discharged from the ink jet recording head to be insoluble or to agglomerate, comprising the steps of selectively effecting recording in a low-resolution mode by controlling ink discharge from the ink jet recording head to form a plurality of dots on the recording medium by the ink discharged from the ink jet recording head and controlling feeding of the recording medium, and effecting recording in a high-resolution mode by controlling ink discharge from the ink jet recording head and processing liquid discharge from the liquid jet head to form a plurality of dots by mixing the ink and the processing liquid discharged from the ink jet recording head and the liquid jet head, respectively, on the recording medium, and controlling feeding of the recording medium.

According to yet another aspect, the present invention relates to a recording apparatus comprising conveying means for conveying a recording medium, means for discharging ink onto the recording medium, means for discharging a processing liquid onto the recording medium, the processing liquid for causing a coloring material in the ink to be insoluble or to agglomerate, and control means for effecting recording in a first mode by controlling ink discharge from the ink discharging means to form a plurality of dots on the recording medium and controlling feeding of the recording medium by said conveying means, and for effecting recording in a second mode by controlling ink discharge from the ink discharge means and processing liquid discharge from the processing liquid discharge means to form a plurality of dots by mixing the ink and the processing liquid on the recording medium and controlling feeding of the recording medium by the conveying means.

In the present invention, the processing liquid improves printability, and therefore is also termed a printability-improving liquid.

Improvement in printability includes improvement in the picture quality, such as density, color saturation, the degree of sharpness in edge portions, the size of dots, and the like, improvement in fixability of ink, improvement in weather resistance, such as water resistance, light resistance and the like, i.e., improvement in the shelf life of images, and suppression of generation of bleeding and fogging. The printability-improving liquids contribute to the above-described improvement in printability, and include, for example, liquids which cause a dye in ink to be insoluble, and liquids which cause destruction of dispersion in a pigment in ink. Provision of insolubility is a phenomenon in which anionic radicals included in a dye within ink ionically interact with cationic radicals of a cationic substance included in a printability-improving liquid to produce ionic bonds, and the dye uniformly dissolved in the ink is thereby separated from the solution. Even if the dye within the ink is made partially soluble, the effects of suppressing color bleeding, improving the coloring property, improving the quality of characters, and improving fixability can be obtained. The term "agglomeration" is used in the same meaning as "provision of insolubility" when a color agent used for ink is a water-soluble dye having anionic radicals. When a color agent used for ink is a pigment, the term "agglomeration" includes a phenomenon in which a pigment-dispersing agent or the surface of the pigment ionically interacts with cationic radicals of a cationic substance included in a printability-improving liquid, to cause destruction of dispersion of the pigment and a great increase in the size of particles of the pigment. Usually, the above-described agglomeration causes an increase in the viscosity of the ink. In the present invention, even if a pigment or a pigment-dispersing agent in ink partially agglomerates, the effects of suppressing color bleeding, improving the coloring property, improving the quality of characters, and improving fixability as described in the present invention can be obtained.

According to the above-described configuration, in the high-resolution mode, a color agent of ink is made insoluble or agglomerates as a result of mixing of the ink and a processing liquid, so that dots having a smaller diameter than when dots are formed only by the ink are formed, and recording is controlled so as to densely arrange the small-diameter dots. On the other hand, in the low-resolution mode, only ink is discharged, so that dots having a larger diameter than in the foregoing case are formed, and recording is controlled so as to densely arrange these dots.

It is also possible to perform recording with a dot arrangement in which dots formed on a recording medium can contact each other.

DETAILED DESCRIPTION OF THE PREFERRED EMBODIMENTS

Preferred embodiments of the present invention will now be described in detail with reference to the drawings.

First Embodiment

Figure 1:
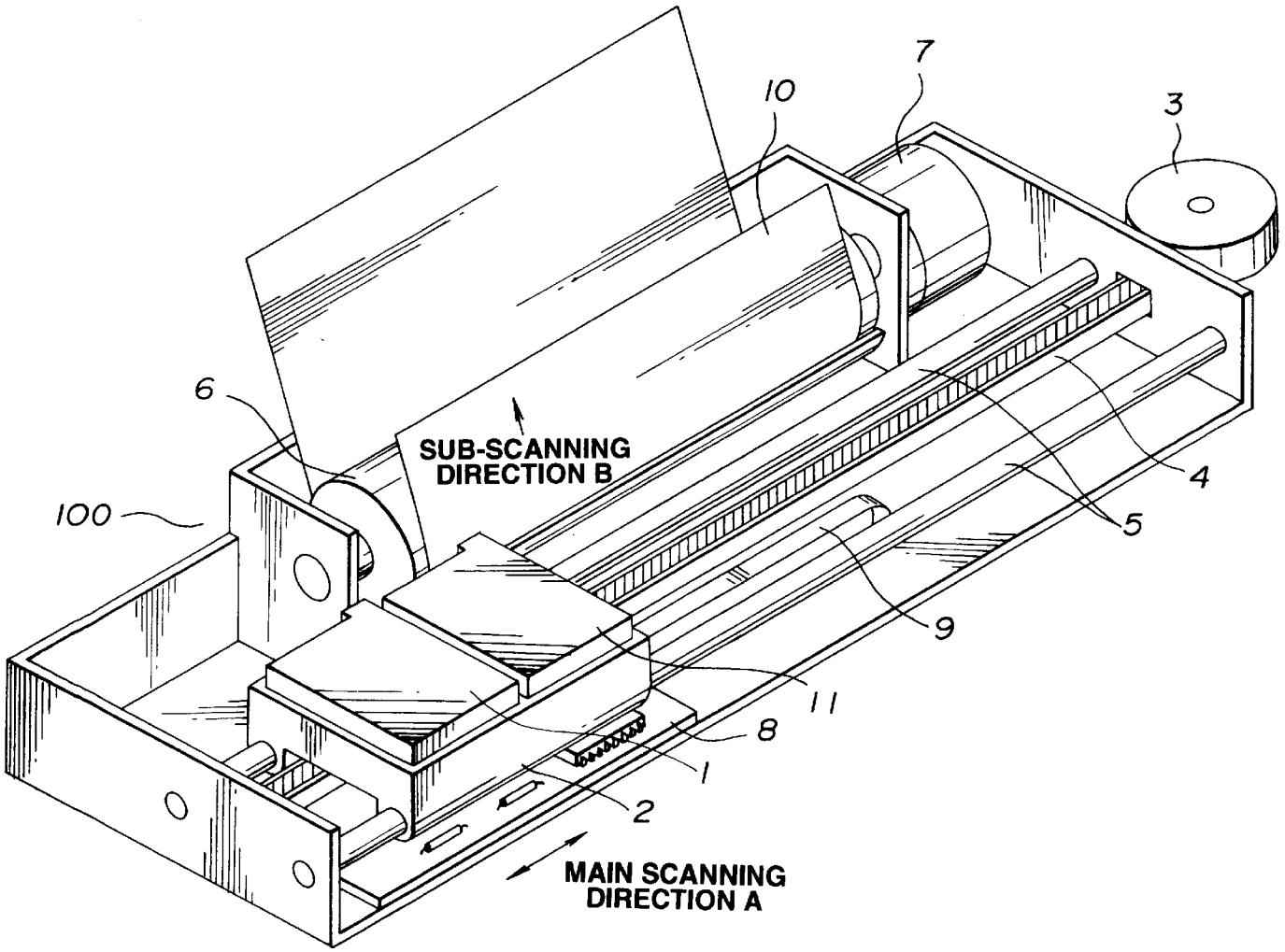
FIG. 1 is a schematic perspective view illustrating the configuration of an ink-jet recording apparatus according to a first embodiment of the present invention.

FIG. 1 is a schematic perspective view illustrating the configuration of an ink-jet recording apparatus according to a first embodiment of the present invention.

Figure 10:
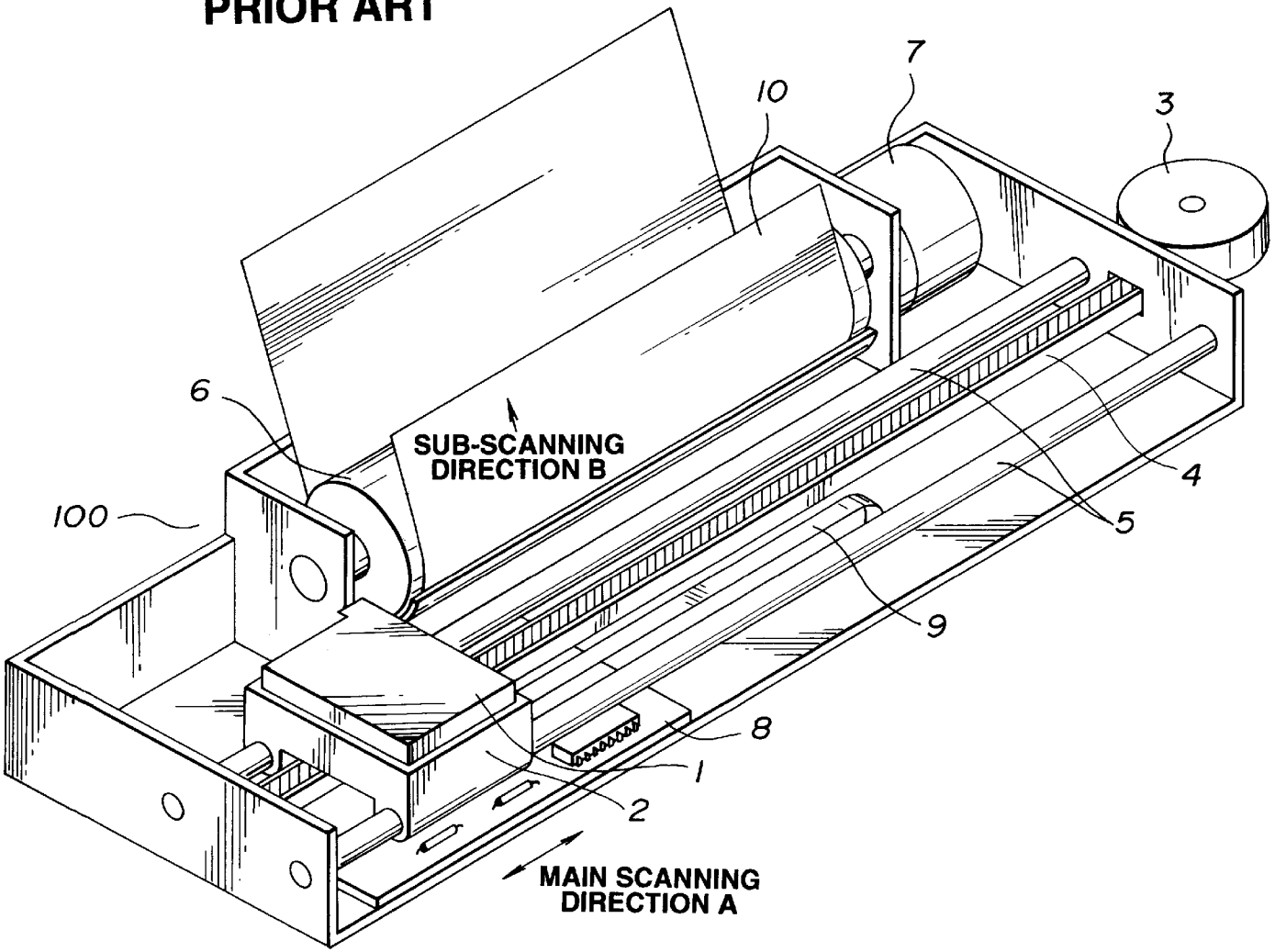
FIG.10 PRIOR ART
FIG. 10 is a perspective view illustrating a conventional ink-jet recording apparatus.

The configuration shown in FIG. 1 differs from that shown in FIG. 10 in that in addition to an ink-jet recording head 1 for discharging ink as a recording liquid, an ink-jet head 11 for discharging a colorless or light-color processing liquid including at least a cationic substance, having a molecular weight equal to or less than 1,500, and a high-molecular substance, having a molecular weight equal to or more than 10,000, for causing the recording liquid to be insoluble is provided. The ink-jet head 11 is disposed on a carriage 2 in its main scanning direction together with the ink-jet recording head 1. The processing liquid is discharged from the head 11 before the ink is discharged from the head 1.

Figure 11:
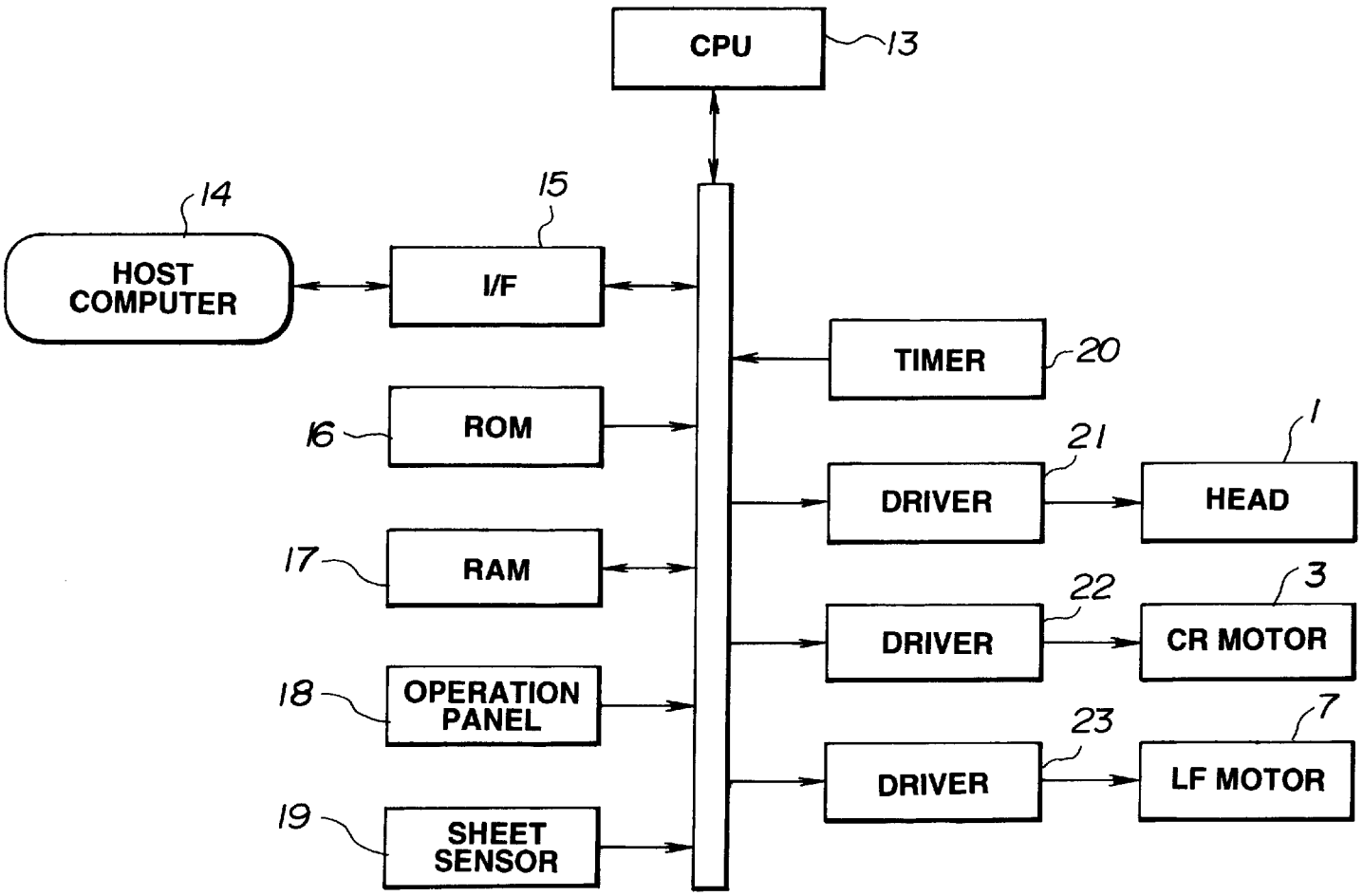
FIG.11 PRIOR ART
FIG. 11 is a block diagram illustrating the configuration of control in the conventional apparatus.
Figure 12:
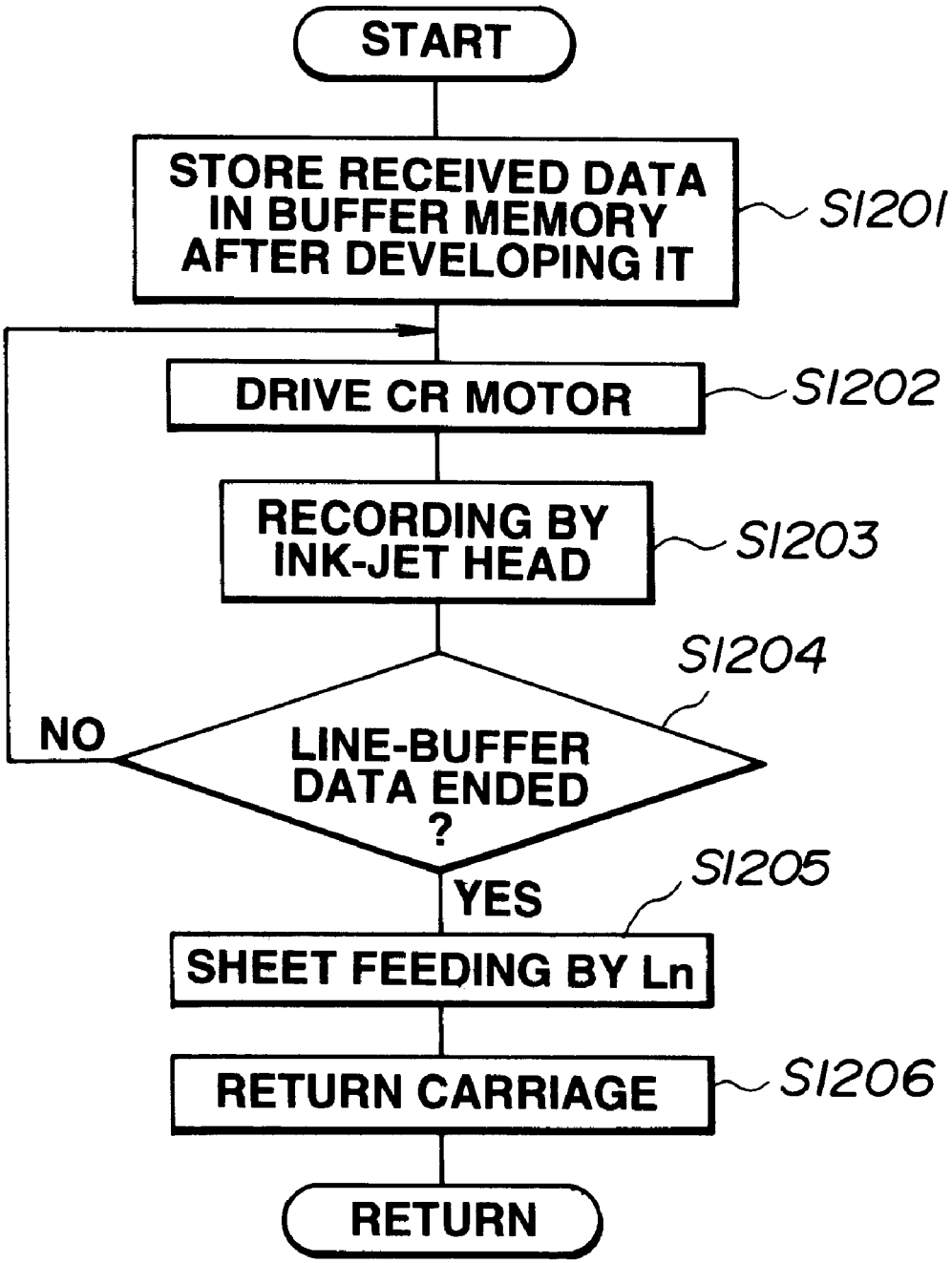
FIG.12 PRIOR ART
FIG. 12 is a flowchart illustrating a recording operation sequence in the conventional apparatus.
Figure 13:
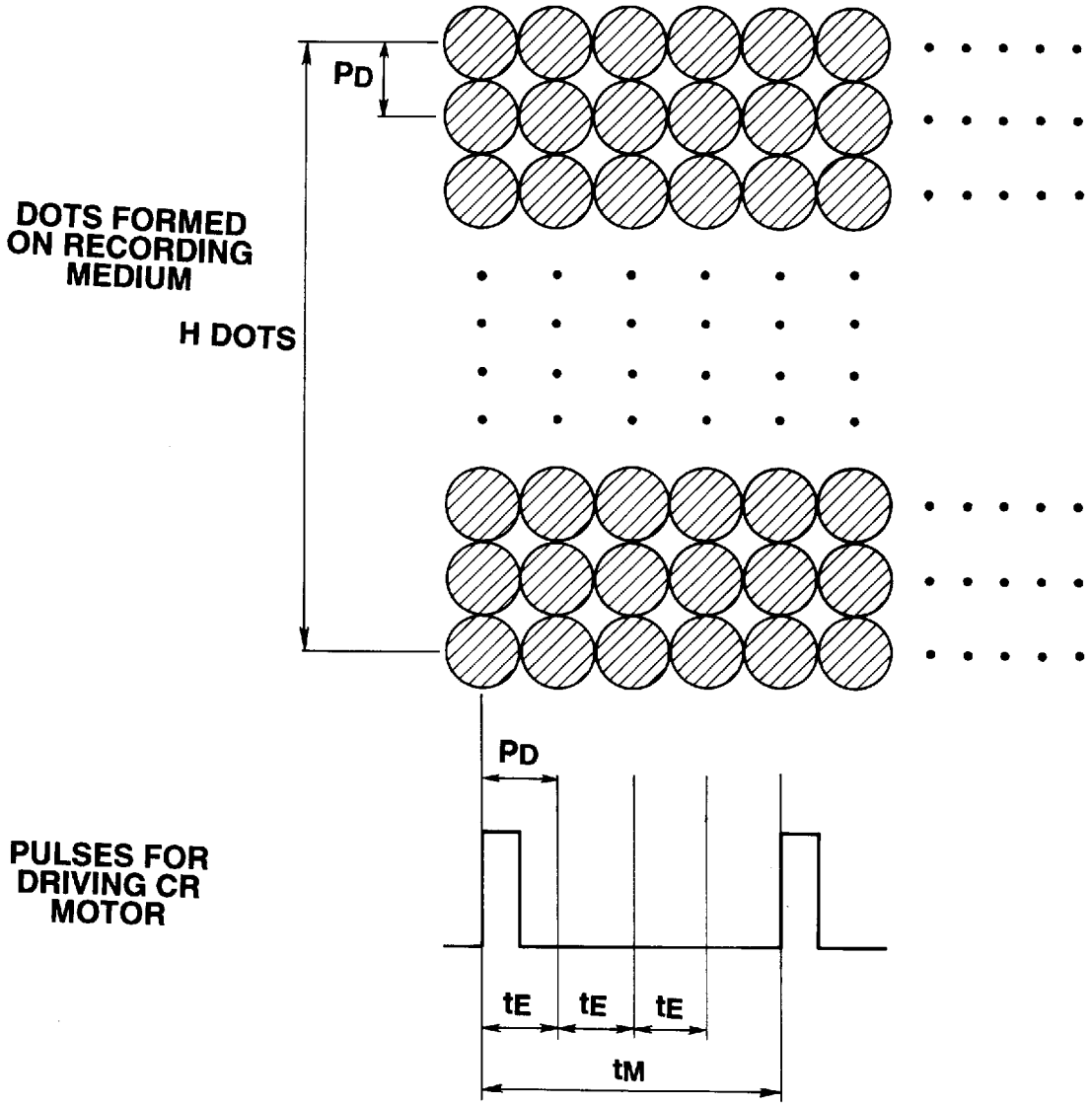
FIG.13 PRIOR ART
FIG. 13 is a diagram illustrating dot formation in the conventional apparatus.

Since the configuration of other components is substantially the same as the configuration shown in FIG. 10, description thereof will be omitted. A control circuit may have the same configuration as that shown in FIG. 11.

The ink-jet recording apparatus of the present embodiment adopts a printing method in which electrothermal transducers are disposed so as to correspond to discharging ports, and ink is discharged from nozzles by applying a driving signal corresponding to printing information to the electrothermal transducers.

Figure 17:
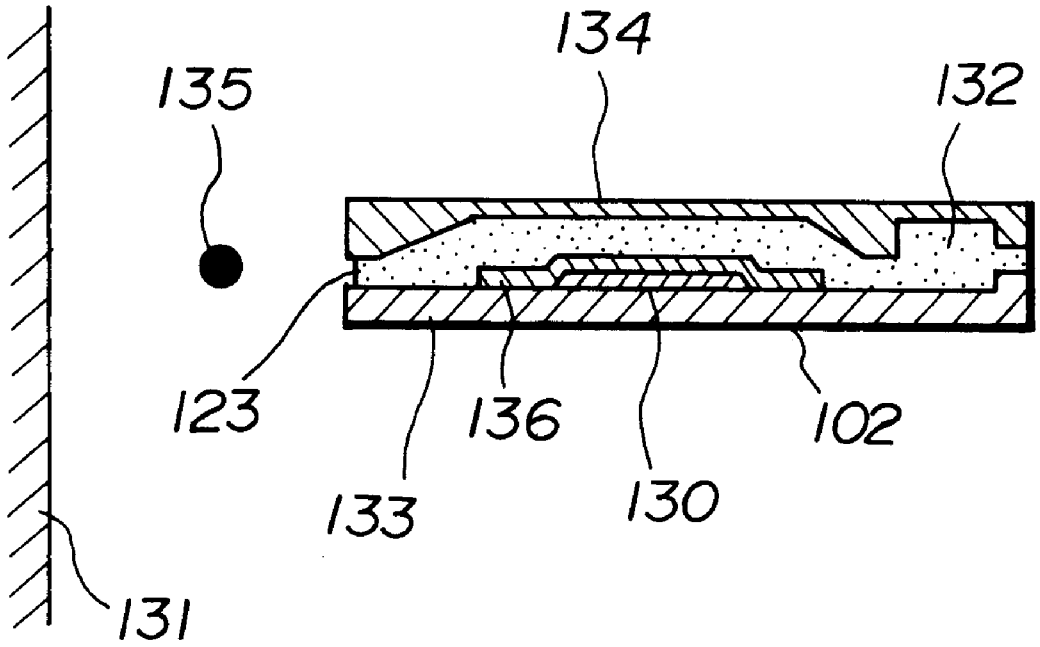
FIG. 17 is an enlarged cross-sectional view of a print head which can be applied to a recording apparatus of the present invention.

FIG. 17 is an enlarged cross-sectional view of a print head to which the present invention can be applied. A heating member 130, serving as an electrothermal transducer of a print head 102, is disposed so as to be able to heat a corresponding discharging port 123 independently. Ink in the vicinity of the heating member 130 rapidly heated thereby forms a bubble due to film boiling. An ink droplet 135 is discharged toward a material 131, on which printing is to be performed, due to the pressure caused by the generation of the bubble to form a character or an image on the material 131. The weight of each colored ink droplet discharged at that time is 15–80 ng (nanograms), for example, about 40 ng.

An ink liquid channel communicating with each discharging port 123 is provided therefor. A common liquid chamber 132 for supplying the ink liquid channels 123 with ink is provided behind the position where the ink liquid channels 123 are disposed. The heating member 130, serving as the electrothermal transducer for generating energy utilized for discharging an ink droplet from the corresponding discharging port 123, and an electrode interconnection for supplying the heating member 130 with electric power are provided for the corresponding ink liquid channel. The heating members 130 and the electrode interconnections are formed on a substrate 133, made of silicon or the like, using a film forming technique. A protective film 136 is formed on the heating member 130 in order to prevent direct contact between ink and the heating member 130. By laminating a barrier wall 134, made of a resin, a glass material or the like, on the substrate 133, the discharging ports 123, the ink liquid channels, the common liquid chamber 132 and the like are formed.

Such a printing method using electrothermal transducers is generally called a bubble-jet printing method, because bubbles formed by applying thermal energy are used when discharging ink droplets.

The recording liquid and the processing liquid discharged from the ink-jet recording head 1 and the ink-jet head 11 comprise a recording liquid including at least a color material and an anionic compound, and a colorless or light-color liquid including at least a cationic substance having a molecular weight equal to or less than 1,500 and a high-molecular substance having a molecular weight equal to or more than 10,000, respectively. A description will now be provided of the functions and the constitutions of these liquids.

Figure 2A:
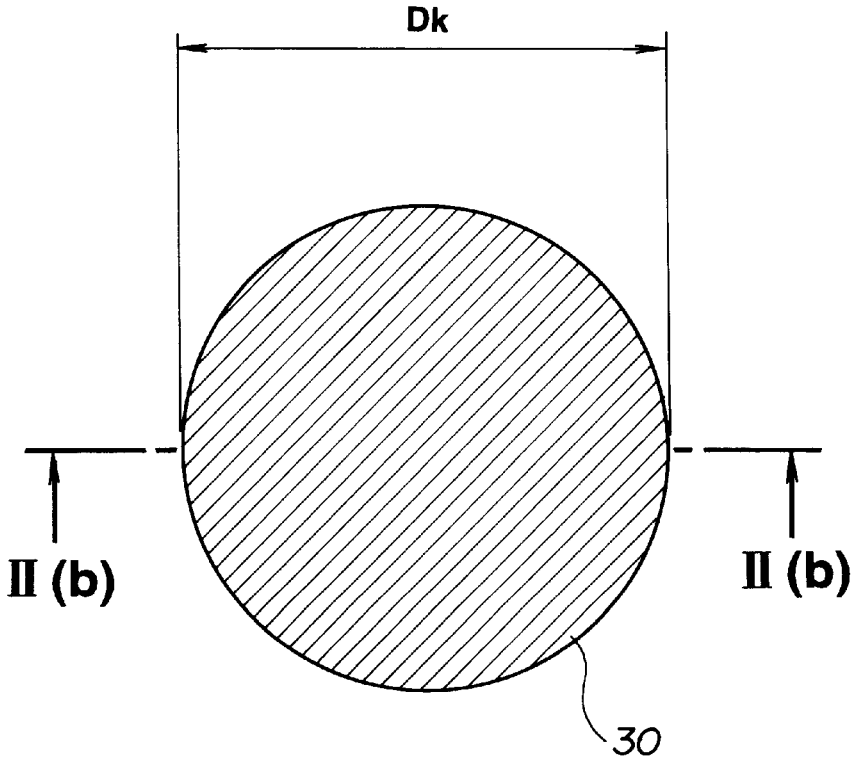
FIGS. 2(*a*) and 2(*b*) are schematic diagrams illustrating a dot formed only by ink.
Figure 2B:
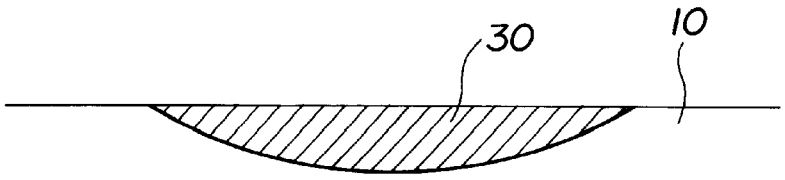

The recording liquid discharged from the ink-jet recording head 1 is so-called ink. FIGS. 2(*a*) and 2(*b*) illustrate a dot formed on a recording medium by ink discharged from the ink-jet recording head 1.

In this dot formation using only the recording liquid, as illustrated in a cross section taken along line II(*b*)—II(*b*) of FIG. 2(*a*) as shown in FIG. 2(*b*), the recording liquid spreads in a state of penetrating into a recording medium 10, and the diameter of a dot 30 formed on the recording medium 10 by only the recording liquid equals $D_k$.

Figure 3A:
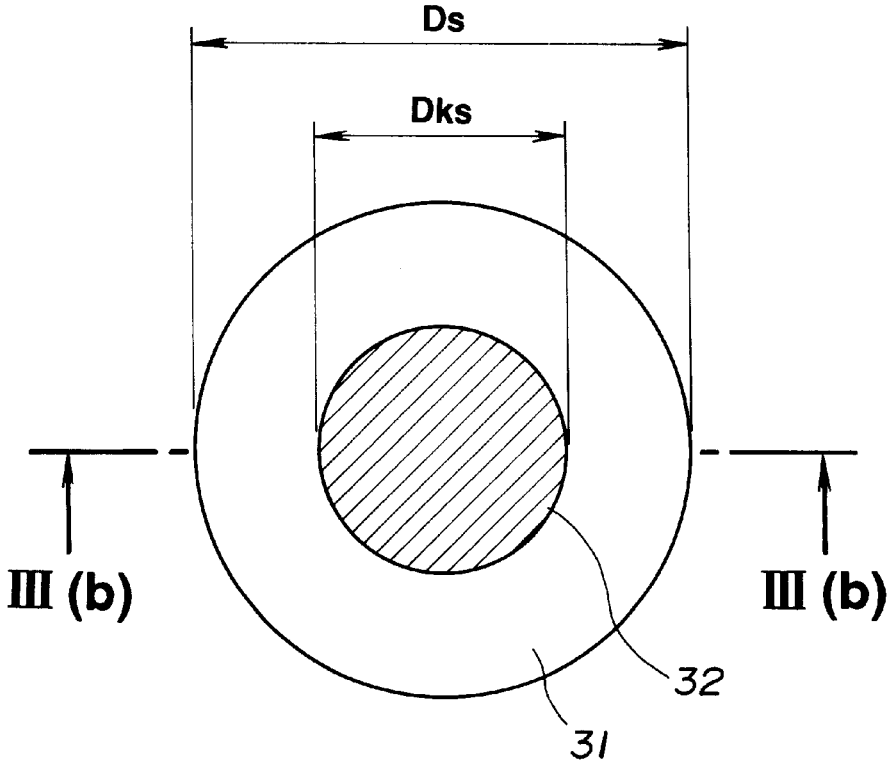
FIGS. 3(*a*) and 3(*b*) are schematic diagrams illustrating a dot formed by mixing of ink and a processing liquid in the first embodiment.
Figure 3B:
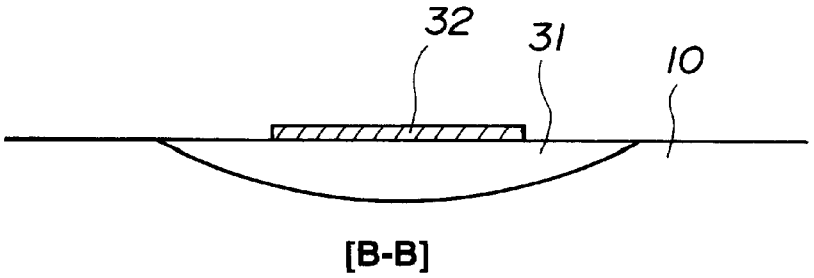

A description will now be provided of dot formation when the processing liquid is first discharged onto an image-forming region of the recording medium 10, or onto the image forming region and in the vicinity thereof, and thereafter the recording liquid is discharged onto the recording medium 10, with reference to FIGS. 3(*a*) and 3(*b*).

As a result of mixing of the colorless processing liquid and the recording liquid on the recording medium 10 or at a portion where the two liquids penetrate, in a first step of reaction, the low-molecular cationic substance included in the colorless processing liquid associates with the color material used in the recording material due to ionic interaction, and the obtained associated substance is instantaneously separated from the solution phase. In a second step of reaction, the associated substance obtained from the dye and the low-molecular cationic substance is adsorbed on the high-molecular substance having the molecular weight equal to or more than 10,000 included within the colorless liquid, so that the size of the dye agglomeration caused by the association further increases, and therefore the dye agglomeration is prevented from penetrating between fibers of the recording medium 10. As a result, only a liquid portion separated from the solid phase penetrates into the recording medium 10, and compatibility between the quality of printing and fixability can be achieved.

That is, as indicated by reference numeral 31 in FIGS. 3(*a*) and 3(*b*), the processing liquid penetrates into the recording medium 10 within the range of a diameter $D_s$ (substantially equal to $D_k$), while a dot 32 formed by the recording liquid does not spread by penetrating into the recording medium 10 due to the agglomeration caused by the mixing with the processing liquid, and forms a dot having a diameter $D_{ks}$, which is substantially ½ of $D_k$.

The essential components which must be included in the colorless or light-color processing liquid are the following two items:

(1) A low-molecular cationic substance having a molecular weight equal to or less than 1,500.

(2) A high-molecular substance having a molecular weight equal to or more than 10,000.

The essential component which must be included in the recording liquid is:

(3) A water-soluble dye containing at least anionic radicals, or a dispersing agent, including at least anionic radicals, and a pigment.

The functions and the effects of these substances in the present embodiment are as described above. That is, the low-molecular cationic substance having a molecular weight equal to or less than 1,500 indicated in the above-described item (1), and the water-soluble dye including at least anionic radicals, or the dispersing agent, including at least anionic radicals, and the pigment indicated in the above-described item (3) form an associated substance due to inonic interaction. The rate of reaction to form the associated substance must be very high.

The functions and the effects of the high-molecular substance having a molecular weight equal to or more than 10,000 indicated in the above-described item (2) in the present embodiment are as described above. That is, in the second step of the reaction between the colorless processing liquid and the recording liquid, the associated substance obtained from the dye and the low-molecular cationic substance is adsorbed on the high-molecular substance, so that the size of the dye agglomeration caused by the association further increases, and therefore the dye agglomeration is prevented from penetrating between fibers of the recording medium 10. As a result, only a liquid portion separated from the solid phase penetrates into the recording medium 10, and compatibility between the quality of printing and fixability can be achieved.

In order to further improve the effects of the present embodiment, a cationic high-molecular substance may also be used in addition to the above-described high-molecular substance.

Although it is desirable that the high-molecular substance and the cationic high-molecular substance are soluble in water, they may have the form of a dispersed substance, such as a latex or an emulsion. The amount of these substances contained in the colorless or light-color liquid (processing liquid) is preferably in the range of 0.005–20 weight %. It is desirable to determine an optimum range depending on the combination of these substances.

The colorless or light-color liquid used in the present embodiment must have a color tone within a range such that the color tone of the recording ink is not changed. The physical properties of the colorless or light-color liquid in the vicinity of 25° C. are: a pH of 3–12, a surface tension of 10–60 dyne/cm, and a viscosity of 1–30 cps.

Next, a description will be provided of the recording ink used in the present embodiment.

The recording ink used in the present embodiment comprises a water-soluble dye including anionic radicals as described above, water, a water-soluble organic solvent, and other components, such as a viscosity-adjusting agent, a pH-adjusting agent, an antiseptic agent, a surface-active agent, an antioxidant, and the like.

Any water-soluble acid dye, direct dye or reactive dye described in a color index (C.I.) may be used as the water-soluble dye including anionic radicals. Any dye including anionic radicals, such as sulfonic radicals, carboxyl radicals or the like, may also be used even if it is not described in the color index. The water-soluble dye includes, of course, a dye whose solubility depends on pH.

A water-soluble organic solvent used in the above-described colorless or light-color liquid may also be used as the water-soluble organic solvent used for the recording liquid. The same preferable range for the contents of the organic solvent may be used for both the recording liquid and the colorless or light-color liquid. The same preferable ranges for the physical properties may also be used for both the recording liquid and the colorless or light-color liquid. However, the surface tension of the colorless or light-color liquid lower than that of the recording liquid is in some cases effective in executing the invention. It is considered that this is because the colorless or light-color liquid discharged onto the recording medium before the recording liquid has the effect of homogenizing wettability of the recording liquid, although the details are not clear.

In order to more effectively execute the invention, an anionic surface-active agent or an anionic high-molecular substance may be included in addition to the above-described components. The above-described amphoteric surface-active agent may be used by adjusting its pH to a value equal to or more than its isoelectric point. A typical agent of a carboxyl-acid-salt type, a nitric-ester type, a sulfonate type, a phosphoric-ester type or the like may be used as the anionic surface-active agent without causing any problem. An alkali-soluble resin, such as soda polyacrylate, a copolymer obtained by copolymerizing acrylic acid with a part of a high-molecular substance, or the like, may be used as the anionic high-molecular substance, although many other substances may also be used.

The colorless processing liquid (hereinafter simply termed a "liquid") for causing the ink dye insoluble may, for example, be obtained in the following manner.

That is, the following components are mixed and dissolved. The obtained mixture is subjected to pressure filtration using a membrane filter (product name: Fluoropore Filter made by Sumitomo Electric Industries, Ltd.) having a pore size of 0.22 $\mu$m, and is adjusted to a pH of 4.8 using NaOH. Thus, a colorless liquid A1 is obtained.

Components of A1

A low-molecular component of a cationic compound

| | | |
|---|---|---|
| stearyl trimethyl ammonium chloride (product name: Electrostopper QE made by Kao Corporation) | 2.0 | parts by weight |
| A high-molecular component of a cationic compound polyamine sulfone (average molecular weight: 5,000) (product name: PAS-92 made by Nitto Boseki Co., Ltd.) | 3.0 | parts by weight |
| Tiodiglycol | 10 | parts by weight |
| Water | 85 | parts by weight |

A preferred example of ink to be mixed with the above-described colorless liquid to become insoluble is as follows.

That is, the following components are mixed, and the obtained mixture is subjected to pressure filtration using a membrane filter (product name: Fluoropore Filter made by Sumitomo Electric Industries, Ltd.) having a pore size of 0.22 $\mu$m. Thus, yellow ink Y1, magenta ink M1, cyan ink C1 and black ink K1 are obtained.

| | | |
|---|---|---|
| C.I. direct yellow 142 | 2 | parts by weight |
| Thiodiglycol | 10 | parts by weight |
| Acetylenol EH (made by Kawaken Fine Chemical) | 0.05 | parts by weight |
| Water | 87.95 | parts by weight |

M1

The same components as Y1 except that the dye is replaced by 2.5 parts by weight of C.I. acid red 289

C1

The same components as Y1 except that the dye is replaced by 2.5 parts by weight of C.I. acid blue 9

K1

The same components as Y1 except that the dye is replaced by 3 parts by weight of C.I. food black 2

Figure 4:
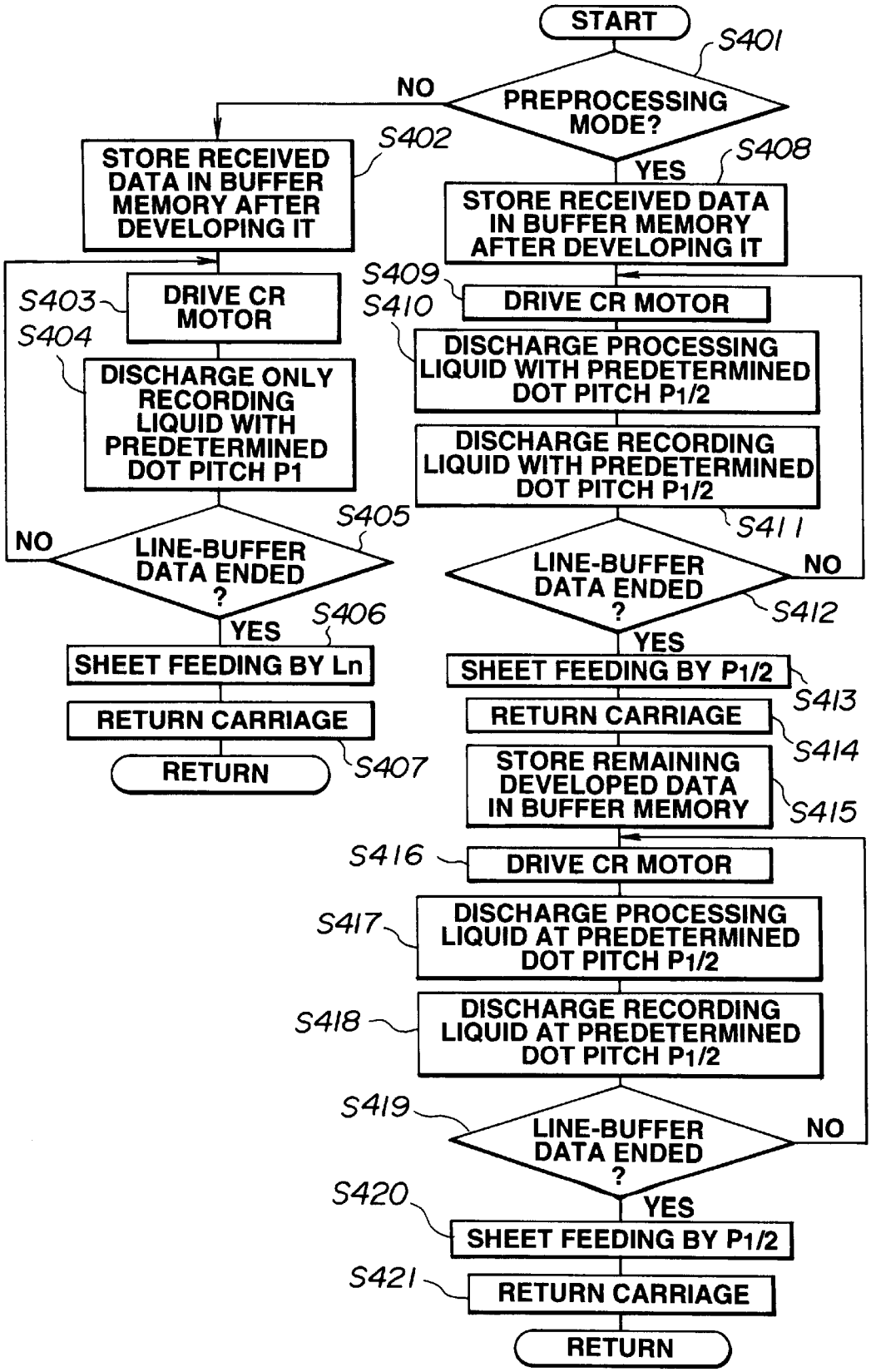
FIG. 4 is a flowchart illustrating a recording operation sequence according to the first embodiment.

Next, a description will be provided of a recording sequence in the ink-jet recording apparatus of the present embodiment with reference to FIG. 4.

First, when recording data has been transmitted from the host computer 14, the CPU 13 determines if a preprocessing mode is selected according to an input state of the operation panel 18 (step S401). If the result of the determination is negative, the process proceeds to step S402, where the recording data transmitted from the host computer 14 is developed in a data form so as to be able to discharge ink from the recording head 1, and the developed data is stored in a buffer memory for one line of the RAM 17 (step S402). Thereafter, the carriage motor 3 is driven to move the ink-jet recording head 1, and recording is performed by forming dots on the recording medium by only discharging ink, serving as the recording liquid, from the ink-jet recording head 1 (steps S403 and S404).

Figure 5:
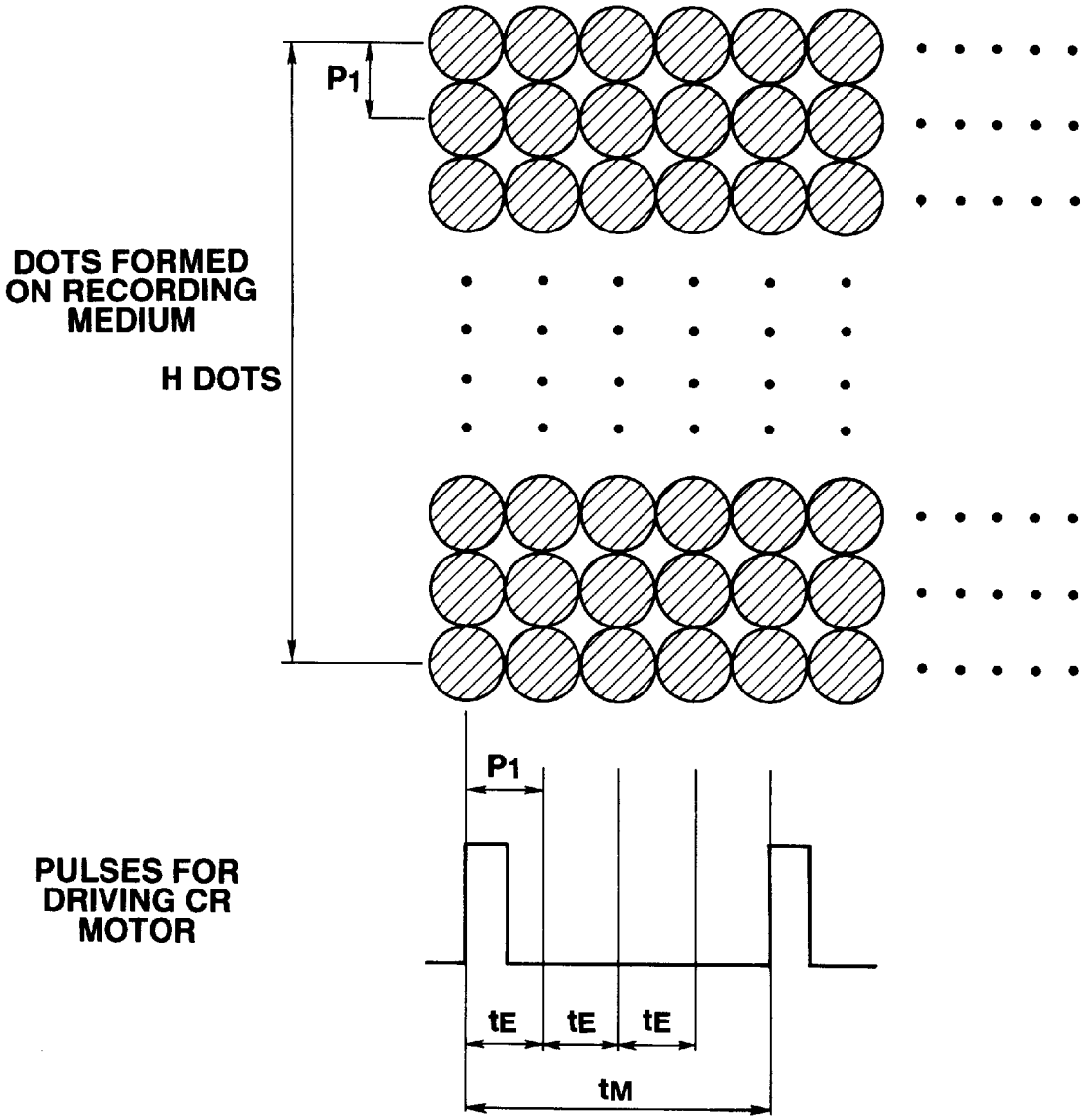
FIG. 5 is a diagram illustrating dot formation in a low-resolution mode in the first embodiment.

FIG. 5 illustrates a method for forming recording dots at that time.

The ink-jet recording head 1 includes discharging ports, whose number equals H (for example 64), for discharging ink, serving as the recording liquid, arranged at a pitch $P_1$. The diameter of a dot formed by ink discharged from each of the discharging ports is set to an optimum size to cover the pitch $P_1$. The timing of ink discharge from the ink-jet recording head 1 while performing main scanning is provided so as to be synchronized with driving pulses for driving the CR motor 3. That is, for example, the diameter of a pulley (not shown) is set so that the moving distance of the ink-jet recording head 1 by a one-pulse drive of the CR motor 3 equals an integer multiple (four times in the case of FIG. 5) of the predetermined pitch $P_1$, and ink is discharged at a predetermined time interval $t_E$ set by a timer 20 during consecutive motor driving pulses. The time interval $t_E$ is set so that the pitch of formed dots equals $P_1$ in consideration of the carriage speed of the CR motor 3.

Figure 14:
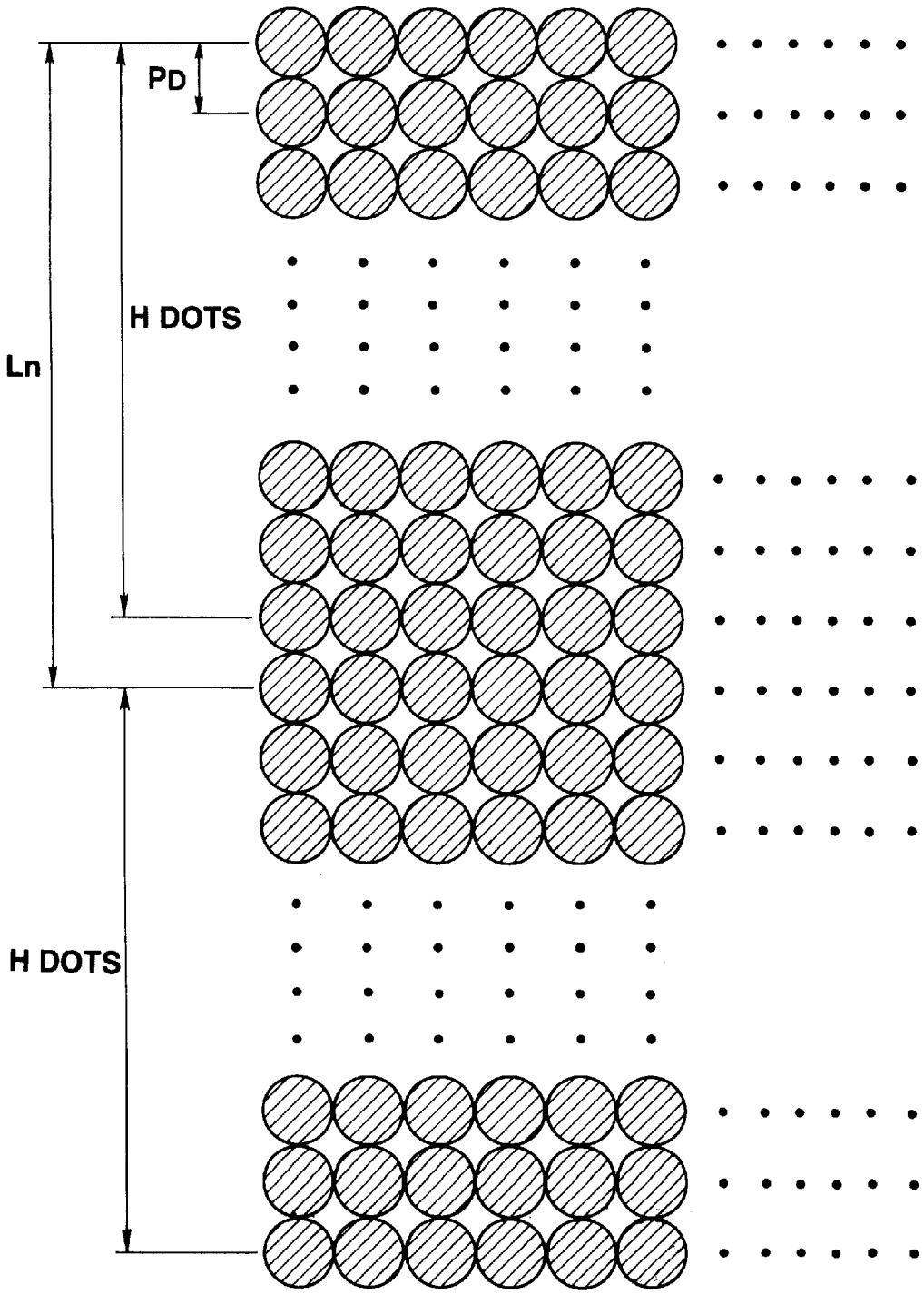
FIG.14 PRIOR ART
FIG. 14 is a schematic diagram illustrating dots obtained by the conventional dot formation.
Figure 15:
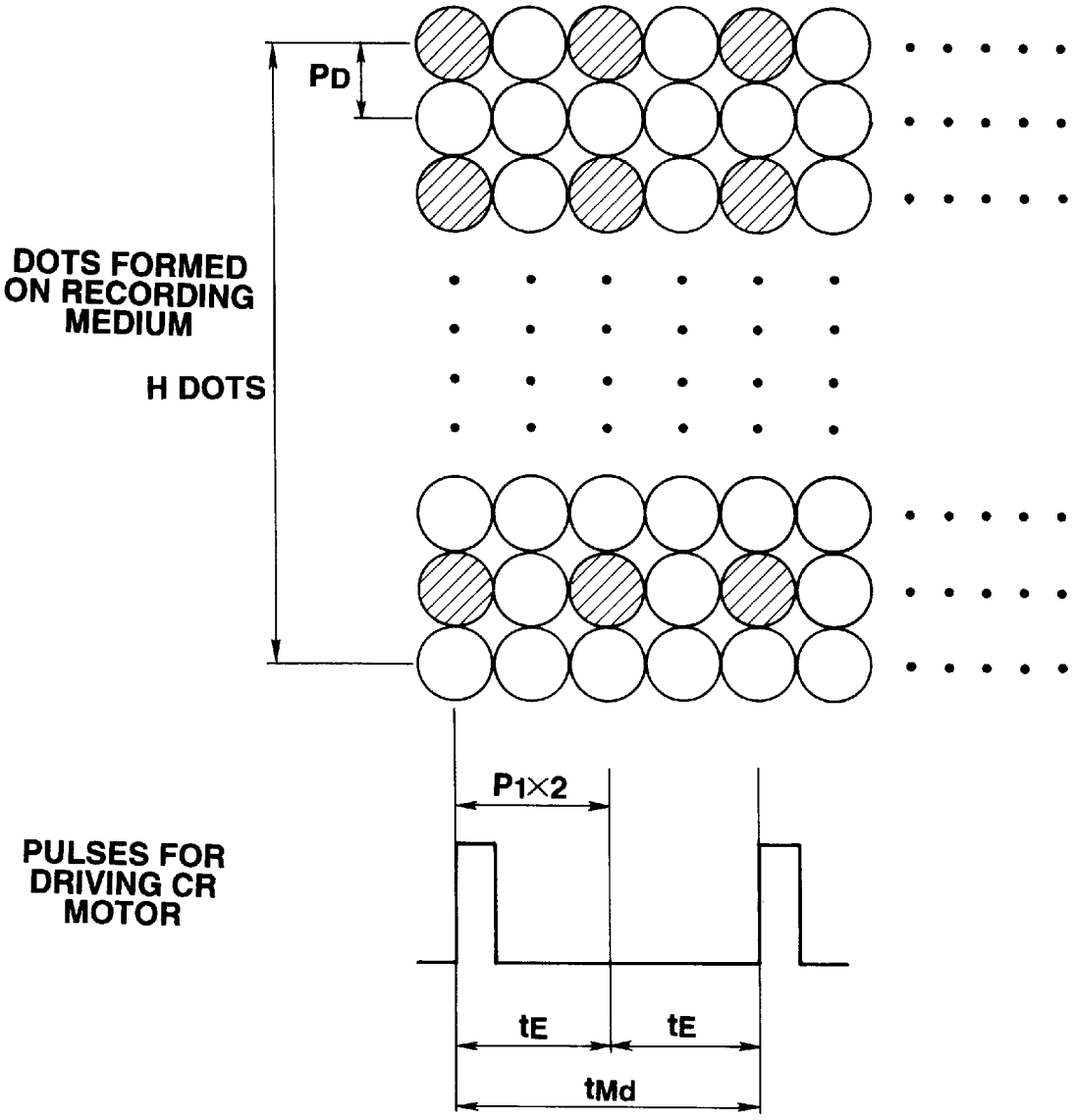
FIG.15 PRIOR ART
FIG. 15 is a diagram illustrating dot formation in the conventional apparatus.
Figure 16:
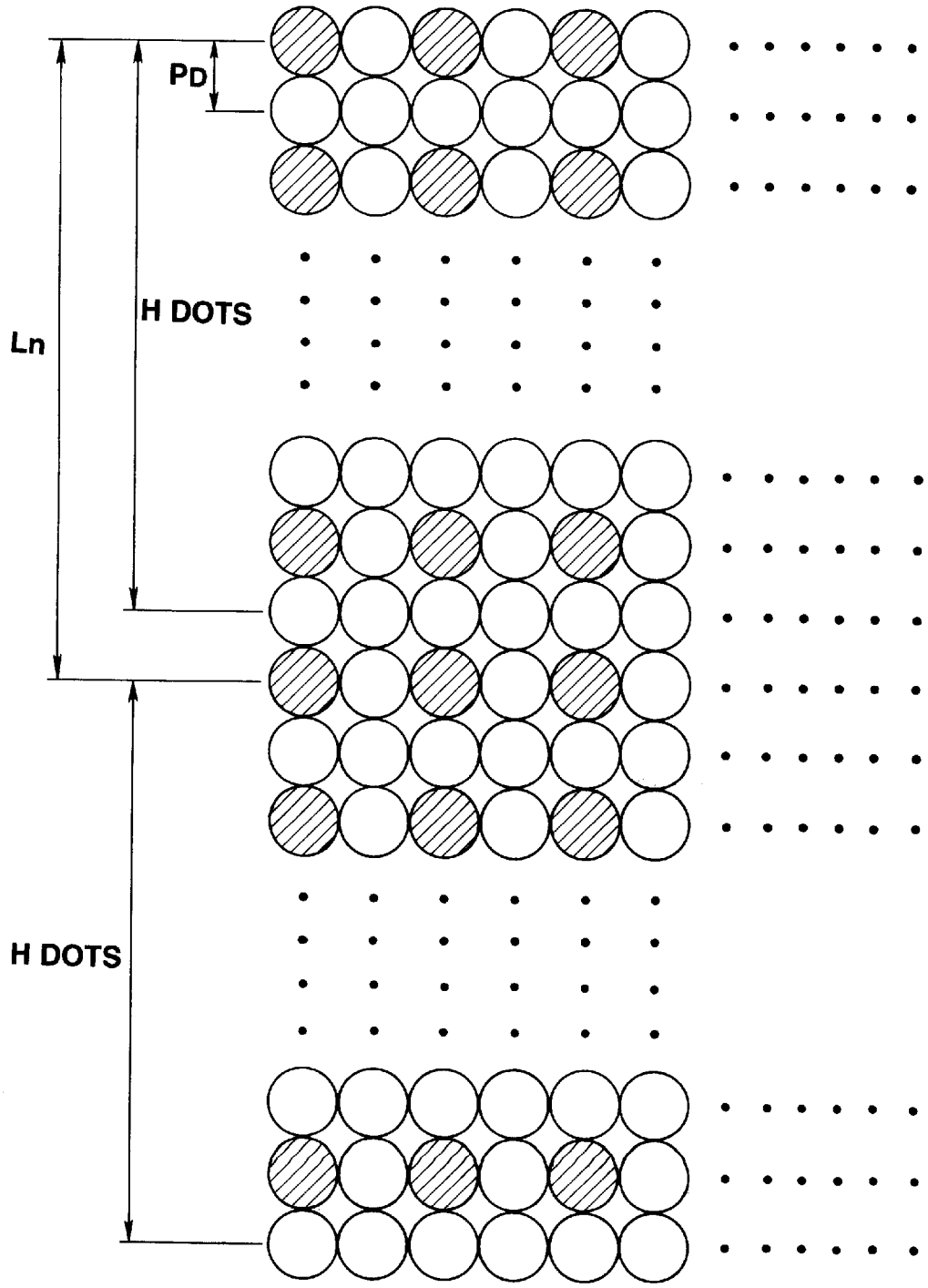
FIG.16 PRIOR ART
FIG. 16 is a schematic diagram illustrating dots obtained by the conventional dot formation.

When recording based on recording data for one line stored in the line buffer has been completed, the recording medium is conveyed, as in the conventional case shown in FIG. 14, by a distance $L_n$, which equals $H \times P_1$, in the sub-scanning direction by the conveying roller 6 by driving the LF motor 7 (step S406). Then, the carriage 2 is returned to its start position, and the recording operation for one line is completed. When the received data still remains, the processing of steps S402–S407 is repeated.

As described above, in the mode in which preprocessing is absent, the recorded dots are set to an optimum size for recording the pitch $P_1$, and are arranged at the pitch $P_1$. Hence, it is possible to obtain a result of recording having a sufficiently high density and an excellent image quality in accordance with the number of dots.

When the preprocessing mode is selected, i.e., when the CPU 13 determines in step S401 that the preprocessing mode is selected, the recording data transmitted from the host computer 14 is developed in the form of discharging data, and the developed data is stored in the buffer memory of the RAM 17 (step S408). At that time, the data is developed with a resolution twice the dot resolution in the above-described non-preprocessing mode determined from the pitch $P_1$ of the discharging ports of the ink-jet recording head 1. For example, if the dot resolution equals 360 dots/inch in the non-preprocessing mode, the data is developed with a resolution of 720 dots/inch. Data of odd rows is stored in the line buffer as data in the main scanning direction.

Figure 6:
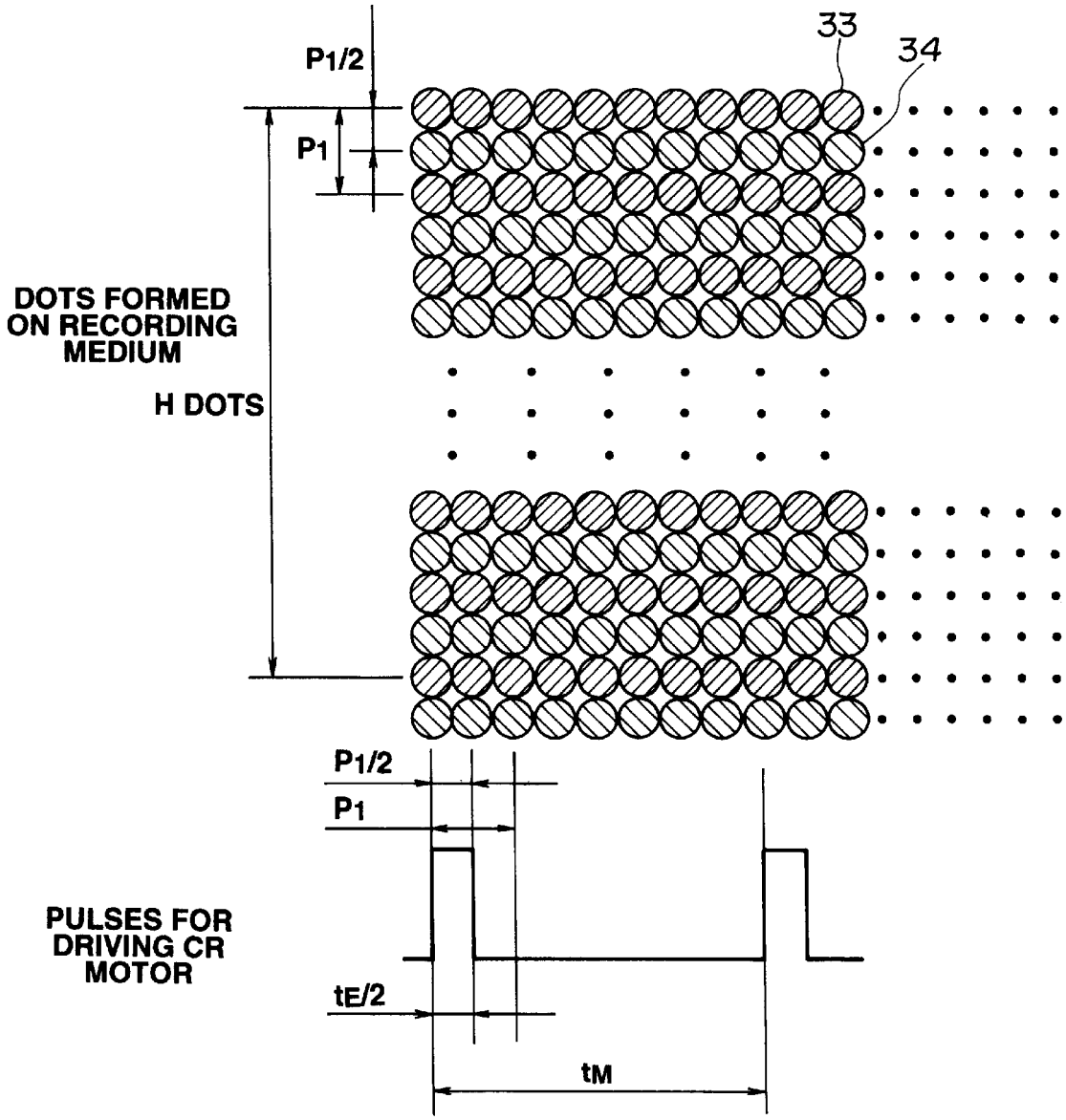
FIG. 6 is a diagram illustrating dot formation in a high-resolution mode in the first embodiment.

That is, as shown in FIG. 6, data is set so that black dots represented by reference numeral 33 are to be recorded.

Then, the carriage 2 is moved by driving the carriage motor 3, and the processing liquid is discharged onto the recording medium 10 from the ink-jet head 11 mounted on the carriage 2. Thereafter, ink, serving as the recording liquid, is discharged from the ink-jet recording head 1 on the same positions as those where the discharged processing liquid is present on the recording medium 10 to perform recording by forming dots (steps S409, S410 and S411).

Each of the ink-jet head 11 and the ink-jet recording head 1 has H discharging ports for discharging the processing liquid and the ink, respectively, each of the discharging ports being disposed at the pitch $P_1$. As described with reference to FIG. 3, The size of dots formed by mixing the processing liquid and the ink discharged from the respective discharging ports can be reduced to substantially ½ of the size of the pitch $P_1$. It is thereby possible to make the pitch of dots $P_1/2$, and therefore to double the resolution.

In the same manner as described above, the timing of discharge of the ink and the processing liquid from the discharging ports of each of the heads while performing main scanning is provided so as to be synchronized with driving pulses for driving the CR motor 3. That is, as described in the case of the non-preprocessing mode, for example, the diameter of a pulley (not shown) is set so that the moving distance of the ink-jet head 11 and the ink-jet recording head 1 by a one-pulse drive of the CR motor 3 equals an integer multiple of the predetermined pitch $P_1$. Since the data is recorded with a resolution twice the resolution in the non-preprocessing mode, the ink is discharged at a predetermined time interval $t_E/2$ set by the timer 20 during consecutive motor driving pulses. The time interval $t_E/2$ is calculated so that the pitch of dots formed from the carriage speed of the CR motor 3 equals $P_1/2$.

When recording of recording data stored in the line buffer has been completed, the conveying roller 6 is rotated by driving the LF motor 7 so as to convey the recording medium 10 by $P_1/2$ in the sub-scanning direction (step S413).

Then, the carriage 2 is returned to its initial position in the main scanning direction (step S414), and data of even rows from among the data developed in step S408 is set in the line buffer (step S415). That is, as shown in FIG, 6, the data is set so that black dots represented by reference numeral 34 are recorded. The processing of steps S416–S419 is performed as in the case of steps S409–S412.

When recording of recording data stored in the line buffer has been completed, the recording medium 10 is conveyed in the sub-scanning direction by a distance $(L_n-P_1/2)$, obtained by subtracting the previously conveyed distance $P_1/2$ from the distance $L_n=H\times P_1$, by rotating the conveying roller 6 by driving the LF motor 7 (step S420), the carriage 2 is returned to its start position (step S421), and the recording of one line is completed.

When the received data still remains, the processing of steps S408–S421 is repeated.

In the above-described case of the preprocessing mode, recorded dots are set to an optimum size for recording the pitch $P_1/2$, and are arranged with the pitch $P_1/2$. Accordingly, as in the case of the non-preprocessing mode, it is possible to realize a density corresponding to the number of dots, and therefore to obtain an excellent image quality.

That is, as described above, the recording apparatus of the present embodiment has a low-resolution recording mode and a high-resolution recording mode, and the size of recorded dots can be optimized for the corresponding resolution in each of the recording modes. Hence, it is possible to realize a high density in an excellent state, and therefore to obtain a result of recording with high quality.

Although in the above-described embodiment, the processing liquid and the ink are discharged onto substantially the same positions on the recording medium, the present invention is not limited to such an approach. The processing liquid may be discharged onto a position where the processing liquid and the ink are mixed to cause the ink to be insoluble, for example, in the vicinity of a position where the ink is discharged.

Second Embodiment

In a second embodiment of the present invention, recording is performed at a speed higher than in the first embodiment. In the first embodiment, dots formed by discharging the processing liquid and the ink onto the same positions are set to an optimum size for covering the pitch $P_1/2$, i.e., ½ of the pitch $P_1$ between adjacent nozzles of each of the ink-jet head and the ink-jet recording head. In the second embodiment, however, dots formed by discharging the processing liquid and the ink onto the same positions are set to an optimum size for covering the pitch $P_1$ between adjacent nozzles of each of the ink-jet head and the ink-jet recording head.

Figure 7:
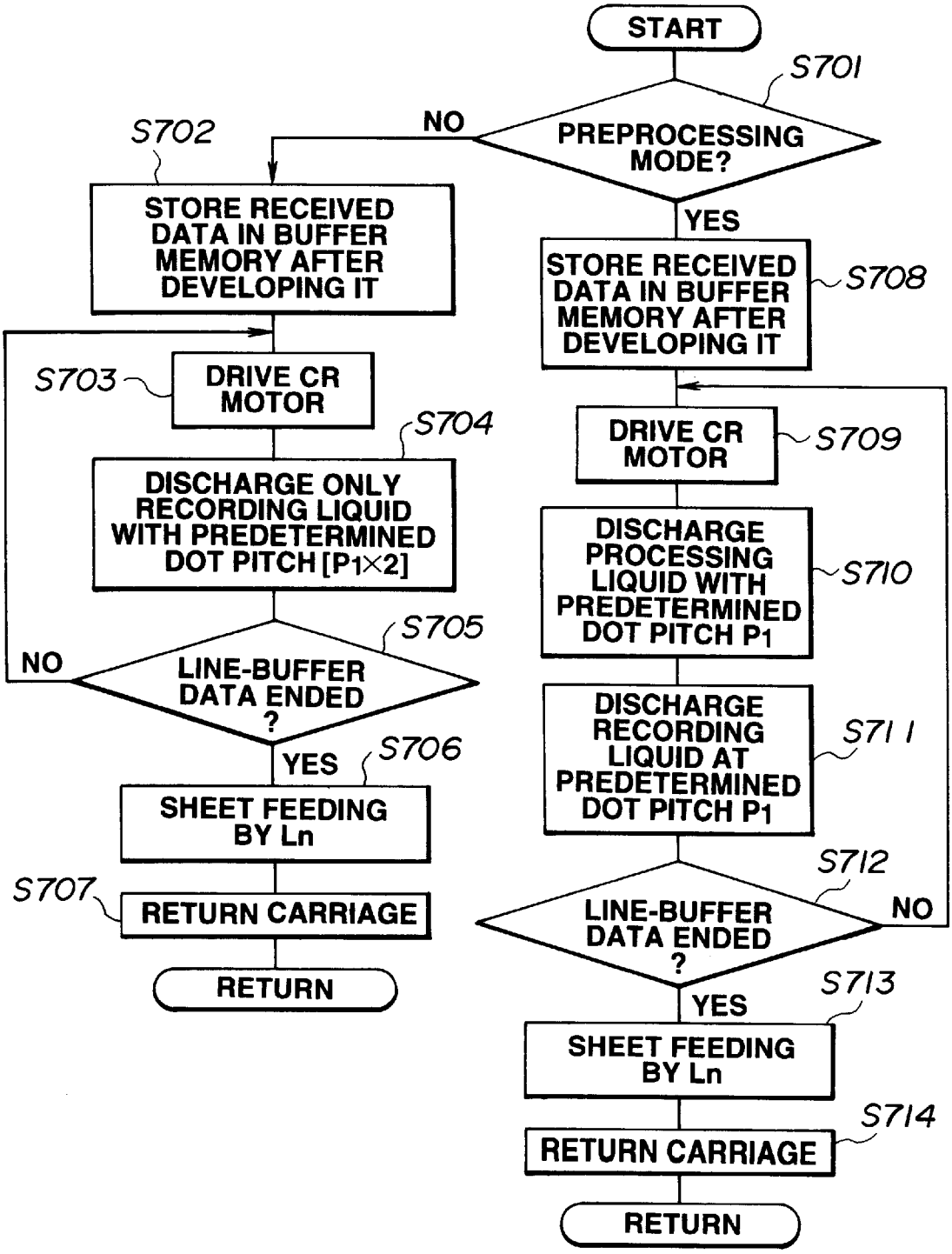
FIG. 7 is a flowchart illustrating a recording operation sequence according to a second embodiment of the present invention.

FIG. 7 is a flowchart illustrating a recording sequence in the second embodiment.

When the CPU 13 determines in step S701 that the mode is not the preprocessing mode, recording data transmitted from the host computer 14 is developed in the form of discharging data for the recording head 1, and the developed data is stored in the buffer memory for one line of the RAM 17 (step S702). At that time, the received data is developed so that recorded dots are arranged with a dot density equal to half the resolution determined from the pitch $P_1$ of the discharging ports of the ink-jet head 11 and the ink-jet recording head 1. That is at a pitch equal to $P_1\times2$. For example, if the pitch of the heads would result in a dot density of 360 dots/inch, the data is developed with a dot density of 180 dots/inch.

Then, the carriage 2 is moved, and recording is performed by forming dots on the recording medium 10 by only discharging the ink, serving as the recording liquid, from the ink-jet recording head 1 (steps S703 and S704).

The ink-jet recording head 1 includes H discharging ports for discharging the ink, serving as the recording liquid, arranged at the pitch $P_1$. As described above, the diameter of a dot formed only by ink discharged from each of the discharging ports is set to an optimum size to cover the pitch $P_1\times2$.

Figure 8:
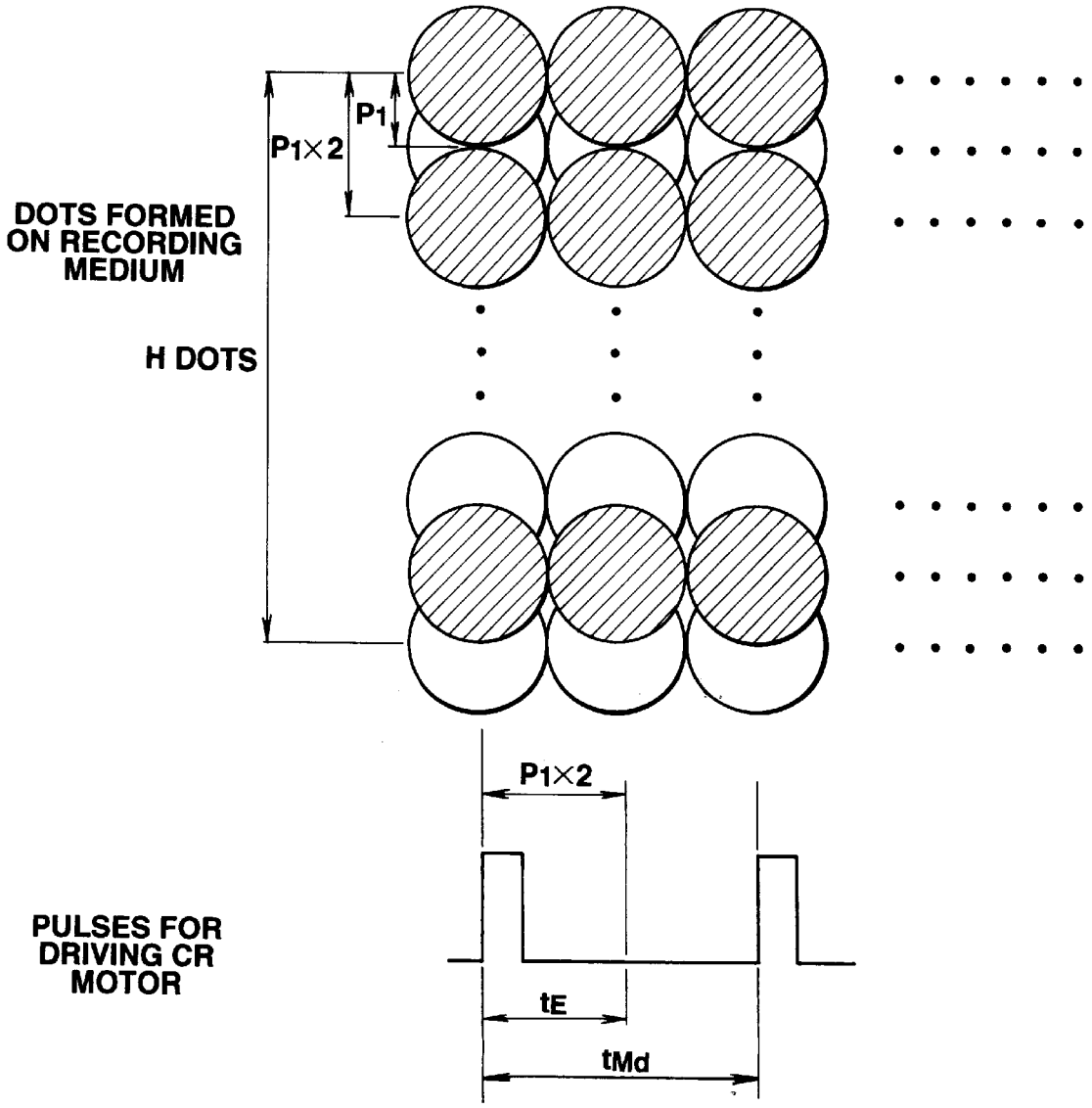
FIG. 8 is a diagram illustrating dot formation in a low-resolution mode in the second embodiment.

FIG. 8 illustrates a method for forming recorded dots at that time.

As in the first embodiment, the timing of ink discharge from each of the discharging ports while performing main scanning is provided so as to be synchronized with driving pulses for driving the CR motor 3. That is, for example, the diameter of a pulley (not shown) is set so that the moving distance of the ink-jet recording head 1 by a one-pulse drive of the CR motor 3 equals an integer multiple of the predetermined pitch $P_1$ and the ink is discharged at a predetermined time interval $t_E$ set by the timer 20 during consecutive motor driving pulses. The time interval $t_E$ is set so that the pitch of formed dots equals $P_1\times2$ in consideration of the carriage speed of the CR motor 3.

When recording based on the discharging data stored in the line buffer has been completed, the recording medium is conveyed, as in the conventional case shown in FIG. 14, by a distance $L_n$, which equals $H\times P_1$, in the sub-scanning direction by rotating the conveying roller 6 by driving the LF motor 7 (step S706). Then, the carriage 2 is returned to its start position, and the recording operation for one line is completed. When the received data still remains, the processing of steps S702–S707 is repeated.

As described above, in the mode in which preprocessing is absent, the recorded dots are set to an optimum size for recording the pitch $P_1\times2$, and are arranged at the pitch $P_1\times2$. Hence, it is possible to obtain a result of recording having a high density in an excellent state, and an excellent image quality with a relatively high recording speed.

When the mode is the preprocessing mode, recording data for one line is stored in the buffer memory (step S708), and the processing liquid is then discharged from the ink-jet head 11 while moving the carriage 2. Thereafter, the ink, serving as the recording liquid, is discharged from the ink-jet recording head 1 to perform recording by forming dots by mixing the processing liquid and the ink on the recording medium (steps S709, S710 and S711).

Each of the ink-jet head 11 and the ink-jet recording head 1 has H discharging ports for discharging the processing liquid and the ink, serving as the recording liquid, respectively, the discharging ports being disposed at the pitch $P_1$. As described above, the size of dots formed by mixing the processing liquid and the ink discharged from the respective discharging ports is optimized for covering the pitch $P_1$.

Figure 9:
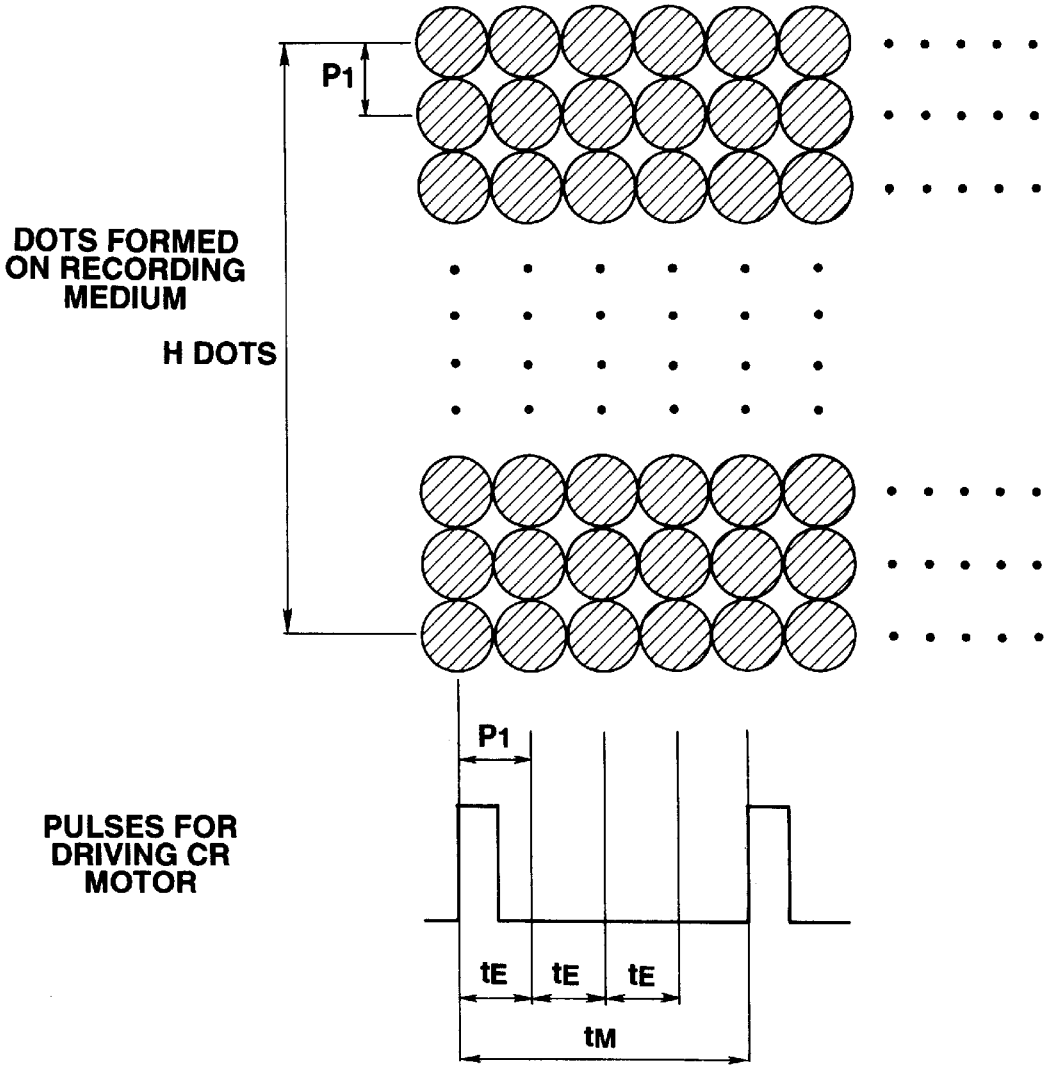
FIG. 9 is a diagram illustrating dot formation in a high-resolution mode in the second embodiment.

FIG. 9 illustrates a method for forming recorded dots at that time.

The timing of ink discharge from the discharging ports while performing main scanning is provided so as to be synchronized with driving pulses for driving the CR motor 3. That is, for example, the diameter of a pulley (not shown) is set so that the moving distance of the ink-jet recording head 1 by a one-pulse drive of the CR motor 3 equals an integer multiple (four times in the case of FIG. 9) of the predetermined pitch $P_1$, and the ink is discharged at a predetermined time interval $t_E$ set by the timer 20 during consecutive motor driving pulses. The time interval $t_E$ is calculated so that the pitch of formed dots equals $P_1$ in consideration of the carriage speed of the CR motor 3.

When recording of the discharging data stored in the line buffer has been completed, the conveying roller 6 is rotated by driving the LF motor 7 so as to convey the recording medium 10 by a distance $L_n$, which equals $H \times P_1$, in the sub-scanning direction, as in the conventional case shown in FIG. 14 (step S713). Then, the carriage 2 is returned to its start position, and recording operation for one line is completed. When the received data still remains, the processing of steps S708–S714 is repeated.

In the above-described case of the preprocessing mode, recorded dots are set to an optimum size for recording the pitch $P_1$, and are arranged with the pitch $P_1$. Accordingly, it is possible to realize a high density in an excellent state, and therefore to obtain a result of recording having an excellent image quality.

That is, as described above, as in the first embodiment, the recording apparatus of the present embodiment has a low-resolution recording mode and a high-resolution recording mode, and the size of recorded dots can be optimized for the corresponding resolution in each of the recording modes. Hence, it is possible to realize a high density in an excellent state, and therefore to obtain a excellent result of recording.

In executing the present invention, the ink to be used is not limited to dye ink. For example, pigment ink obtained by dispersing a pigment in ink may also be used, and a liquid which agglomerates the pigment may be used as the processing liquid. The following combinations of components may be used as examples of pigment ink which causes agglomeration when mixed with the above-described colorless liquid A1. That is, yellow ink Y2, magenta ink Y2, cyan ink C2 and black ink K2, each including a pigment and an anionic compound, can be obtained in the following manner.

Black Ink K2

An anionic high-molecular substance P-1 (an aqueous solution of styrene-methacrylic acid-ethyl acrylate having an acid value of 400, an average molecular weight of 6,000, and 20% of solid component, neutralizer: potassium hydroxide) was used as a dispersing agent. The following materials were mixed in a batch-type vertical sand mill (made by Aimex) while filling glass beads having a diameter of 1 mm as media, and were subjected to dispersion processing for three hours while being cooled. The mixture after dispersion had a viscosity of 9 cps and a pH of 10.0. The dispersed liquid was processed in a centrifugal separator in order to remove coarse particles, and a carbon-black dispersing liquid having a weight average particle size of 100 nm was obtained.

(The Composition of the Carbon-black Dispersing Liquid)

| | | |
|---|---|---|
| P-1 aqueous solution (20% of solid component) | 40 | parts by weight |
| Carbon black Mogul L (made by Cablack) | 24 | parts by weight |
| Glycerin | 15 | parts by weight |
| Ethylene glycol monobutyl ether | 0.5 | parts by weight |
| Isopropyl alcohol | 3 | parts by weight |
| Water | 135 | parts by weight |

Black ink K2 containing a pigment was obtained by sufficiently diffusing the above-described dispersing liquid. The solid component in the final liquid was about 10%.

Yellow Ink Y2

An anionic high-molecular substance P-2 (an aqueous solution of styrene-acrylic acid-methyl methacrylate having an acid value of 280, an average molecular weight of 11,000, and 20% of solid component, neutralizer: diethanolamine) was used as a dispersing agent. Dispersion processing in the same manner as in the case of preparing the black ink K2 was performed using the following materials, and a yellow dispersing liquid having a weight average particle size of 103 nm was obtained.

(The Composition of the Yellow Dispersing Liquid)

| | | |
|---|---|---|
| P-2 aqueous solution (20% of solid component) | 35 | parts by weight |
| C.I. pigment yellow 180 (Novaperin yellow PH-G made by Hoexist) | 24 | parts by weight |
| Triethylene glycol | 10 | parts by weight |
| Diethylene glycol | 10 | parts by weight |
| Ethylene glycol monobutyl ether | 1.0 | part by weight |
| Isopropyl alcohol | 0.5 | parts by weight |
| Water | 135 | parts by weight |

Yellow ink Y2 containing a pigment was obtained by sufficiently diffusing the above-described yellow dispersing liquid. The solid component in the final liquid was about 10%.

Cyan Ink C2

Using the anionic high-molecular substance P-1 used when preparing the black ink K2 as a dispersing agent, and also using the following materials, the same dispersion processing as that for the carbon-black dispersing liquid was performed, and a cyan dispersing liquid having a weight average particle size of 120 nm was obtained.

(The Composition of the Cyan Dispersing Liquid)

| | | |
|---|---|---|
| P-1 aqueous solution (20% of solid component) | 30 | parts by weight |
| C.I. pigment blue 15:3 (Fastgenblue FGF made by Dainippon Ink and Chemicals, Incorporated) | 24 | parts by weight |
| Glycerin | 15 | parts by weight |
| Diethylene glycol monobutyl ether | 0.5 | parts by weight |
| Isopropyl alcohol | 3 | parts by weight |
| Water | 135 | parts by weight |

By sufficiently stirring the obtained cyan dispersing solution, cyan ink C2 containing a pigment for ink-jet recording was obtained. The solid component in the final liquid was about 9.6%.

Magenta Ink M2

Using the anionic high-molecular substance P-1 used when preparing the black ink K2 as a dispersing agent, and also using the following materials, the same dispersion processing as that for the carbon-black dispersing liquid was performed, and a magenta dispersing liquid having a weight average particle size of 115 nm was obtained.

(The Composition of the Magenta Dispersing Liquid)

| | | |
|---|---|---|
| P-1 aqueous solution (20% of solid component) | 20 | parts by weight |
| C.I. pigment red 122 (made by Dainippon Ink and Chemicals, Incorporated) | 24 | parts by weight |
| Glycerin | 15 | parts by weight |
| Isopropyl alcohol | 3 | parts by weight |
| Water | 135 | parts by weight |

By sufficiently diffusing the obtained magenta dispersing solution, magenta ink M2 containing a pigment for ink-jet recording was obtained. The solid component in the final liquid was about 9.2%.

As is apparent from the foregoing description, according to the present invention, in the high-resolution mode, as a result of mixing of the ink and the processing liquid, the ink color material becomes insoluble or agglomerates, so that dots having a smaller diameter than when dots are formed only by the ink are formed, and recording is controlled so as to densely arrange the small-size dots. On the other hand, in the low-resolution mode, only the ink is discharged, so that dots having a larger diameter than in the high-resolution mode are formed, and recording is controlled so as to densely arrange these dots.

As a result, in any of the modes, it is possible to assuredly obtain a density corresponding to the number of dots, to perform excellent high-density recording, and to obtain a high-quality result of recording.

The present invention has excellent effects particularly in a printing apparatus using a print head of an ink-jet printing method, which includes means for generating thermal energy (for example, electrothermal transducers, laser light or the like) as energy utilized for discharging ink and causing a change in the state of the ink by the thermal energy, from among ink-jet printing methods, because high-density and high-definition printing can be achieved according to such a method.

The typical structure and the principle of such devices are preferably the ones disclosed, for example, in U.S. Pat. Nos. 4,723,129 and 4,740,796. The disclosed methods are applicable to a so-called on-demand type and a continuous type. Particularly, however, it is suitable for the on-demand type because the principle is such that at least one driving signal is applied to an electrothermal transducer disposed on a liquid (ink) retaining sheet or liquid channel, the driving signal being enough to provide such a quick temperature rise beyond a departure from nucleate boiling point, by which the thermal energy is provided by the electrothermal transducer to produce film boiling on the heating portion of the print head, whereby a bubble can be formed in the liquid (ink) corresponding to each of the driving signals. By the development and contraction of the bubble, the liquid (ink) is discharged through a discharging port to produce at least one droplet. The driving signal is preferably in the form of a pulse, because the development and contraction of the bubble can be effected instantaneously, and therefore, the liquid (ink) is discharged with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the print head may be as shown in U.S. Pat. Nos. 4,558,333 and 4,459,600 in which the heating portion is disposed at a bent portion, as well as the structure (a linear liquid channel or an orthogonal liquid channel) of the combination of the discharging port, the liquid channel and the electrothermal transducer as disclosed in the above-mentioned patents. In addition, the present invention is applicable to the structure disclosed in Japanese Patent Laid-Open Application (Kokai) No. 59-123670 (1984) wherein a common silt is used as the discharging port for a plurality of electrothermal transducers, and to the structure disclosed in Japanese Patent Laid-Open Application (Kokai) No. 59-138461 (1984) wherein an opening for absorbing pressure waves of the thermal energy is formed corresponding to the discharging ports. This is because the present invention is effective to perform printing with certainty and at high efficiency regardless of the type of the print head.

The present invention may also be effectively applied to a full-line-type print head having a length corresponding to the maximum width of a printing medium which can be printed by the printing apparatus. Such a print head may be configured by a combination of a plurality of print heads for covering the length of the head, or by a single integrally-formed print head.

In addition, the present invention is applicable to a serial-type print head, such as the above-described one, to a replaceable chip-type print head which is connected electrically to the main body of the apparatus and which can be supplied with the ink when it is mounted in the main body, or to a cartridge-type print head having an integral ink container.

The provision of recovery means, preliminary auxiliary means, or the like for the print head in the printing apparatus is preferable, because the effects of the present invention can be further stabilized. Examples of such means include capping means for the print head, cleaning means therefor, pressive or suction means, and an electrothermal transducer, an additional heating element, or preliminary heating means formed by a combination of the electrothermal transducer and the additional heating element. It is also effective for performing stable printing to provide a preliminary discharging mode of performing a discharging operation other than a printing operation.

As regards the variation of the print head mountable, it may be a single head corresponding to single-color ink, or may be a plurality of heads corresponding to a plurality of ink materials having different print colors and densities. The present invention is effectively applied to an apparatus having at least one of a monochromatic mode mainly with black, a multicolor mode with different color ink materials and/or a full-color mode using the mixture of the colors, which may be an integrally formed print head or a combination of a plurality of print heads.

Furthermore, in the foregoing embodiments, the ink has been liquid. It also may be an ink material which is solid below the room temperature but is softened or liquefied at the room temperature. Since the ink is kept within a temperature range between 30° C. and 70° C., in order to stabilize the viscosity of the ink to provide the stabilized discharge in the usual ink-jet method, the ink may be such that it is liquid within the temperature range when a printing signal is applied. In one of them, the temperature rise due to the thermal energy is positively prevented by consuming it for the state change of the ink from the solid state to the liquid state. Another ink material is solidified when it is left unused, to prevent the evaporation of the ink. In either of these cases, in response to the application of the printing signal producing thermal energy, the ink is liquefied, and the liquefied ink may be discharged. Another ink material may start to be solidified when it reaches the printing medium. The present invention is also applicable to such an ink material as is liquefied by the application of the thermal energy. Such an ink material may be retained as a liquid or solid material in through holes or recesses formed in a porous sheet as disclosed in Japanese Patent Laid-Open Application (Kokai) Nos. 54-56847 (1979) and 60-71260 (1985). The sheet is arranged to face the electrothermal transducers. The most effective one of the techniques described above is the film boiling system.

A printing apparatus having a printing mechanism using an ink-jet print head of the present invention may be used, for example, in the form of an image output terminal of an information processing apparatus, such as a computer or the like, a copier combined with a reader or the like, or a facsimile apparatus having transmission and reception functions.

Figure 18:
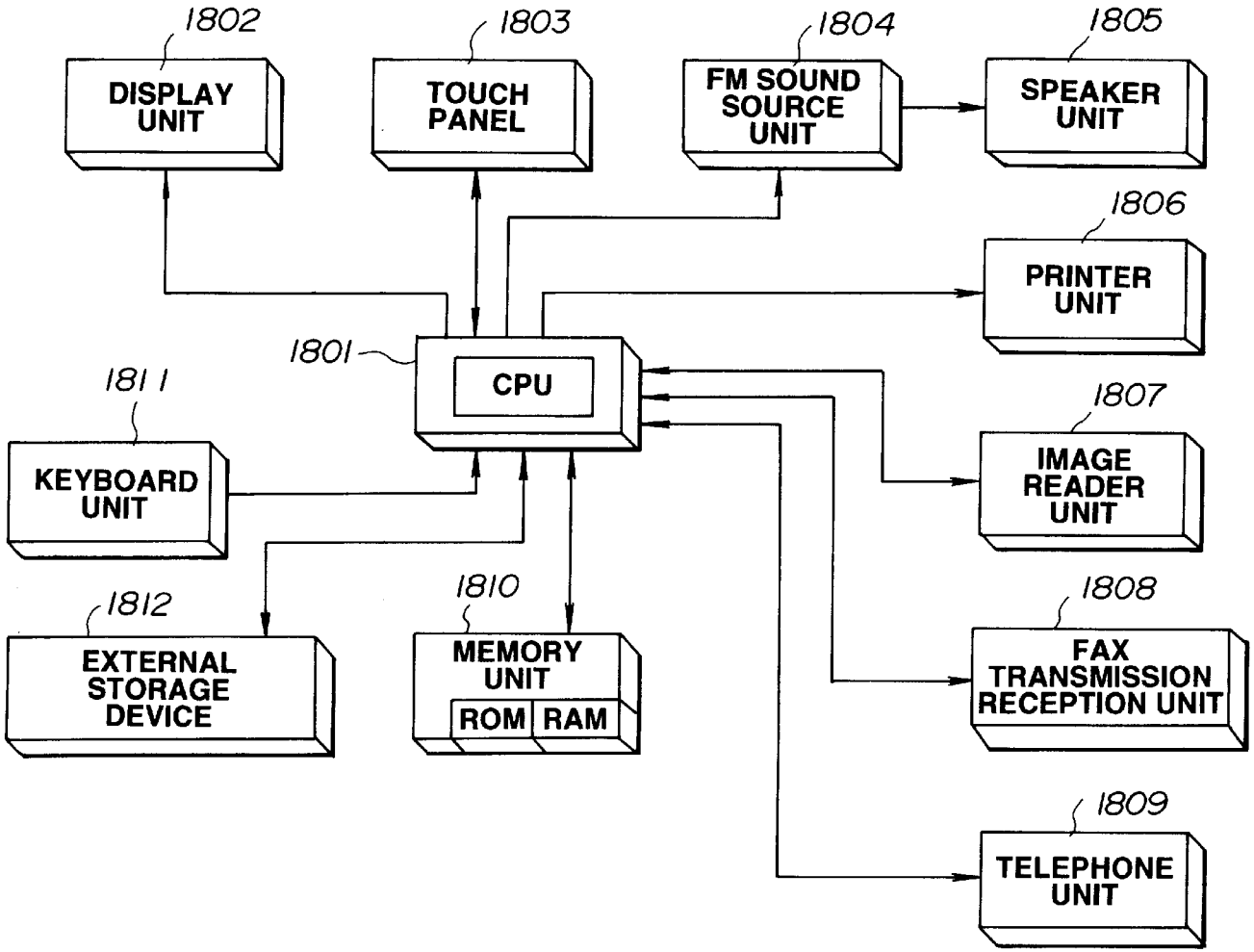
FIG. 18 is a schematic block diagram illustrating the configuration when a printing apparatus of the present invention is applied to an information processing apparatus having functions of a word processor, a personal computer, a facsimile apparatus and a copier.

FIG. 18 is a schematic block diagram illustrating the configuration when a printing apparatus of the present invention is applied to an information processing apparatus having functions of a word processor, a personal computer, a facsimile apparatus and a copier.

In FIG. 18, a control unit 1801 controls the entire apparatus, and includes a CPU, comprising a microprocessor and the like, and various kinds of I/O ports. The control unit 1801 performs control by outputting control signals, data signals and the like to respective units and inputting control signals and data signals from the respective units. A display unit 1802 displays various kinds of menus, document information, image data read by an image reader 1807, and the like on its display picture surface. A transparent pressure-sensitive touch panel 1803 is provided on the display unit 1802. By depressing the surface of the touch panel 1803 with a finger or the like, items, the position of coordinates, or the like can be input on the display unit 1802.

An FM (frequency modulation) sound source unit 1804 stores music information formed by a music editor or the like in a memory unit 1810 or an external storage device 1812 as digital data, and performs FM modulation by reading the stored data from the corresponding storage device. An electrical signal from the FM sound source unit 1804 is converted into audible sound by a speaker unit 1805. The printing apparatus of the present invention is used as a printer unit 1806, which serves as an output terminal of the word processor, the personal computer, the facsimile unit and the copier.

An image reader unit 1807 photoelectrically reads and inputs data of an original, and is provided in the mid-course of a conveying path of the original. The image reader unit 1807 reads a facsimile original, a copy original, or any other kind of original. A facsimile (FAX) transmission/reception unit 1808 performs fascimile transmission of the data of the original read by the image reader 1807, and receives and decodes a transmitted fascimile signal. The FAX transmission/reception unit 1808 has an interface function with external apparatuses. A telephone unit 1809 has an ordinary telephone function and various kinds of other telephone functions, such as a telephone function during absence, and the like.

A memory unit 1810 includes a ROM for storing system programs, manager programs and other application programs, character fonts, dictionaries and the like, application programs and document information loaded from the external storage device 1812, and also includes a video RAM, and the like.

A keyboard unit 1811 is used for inputting document information, various kinds of commands, and the like.

The external storage device 1812 uses floppy disks, hard disks or the like as storage media, and stores document information, music or sound information, the user's application programs, and the like.

Figure 19:
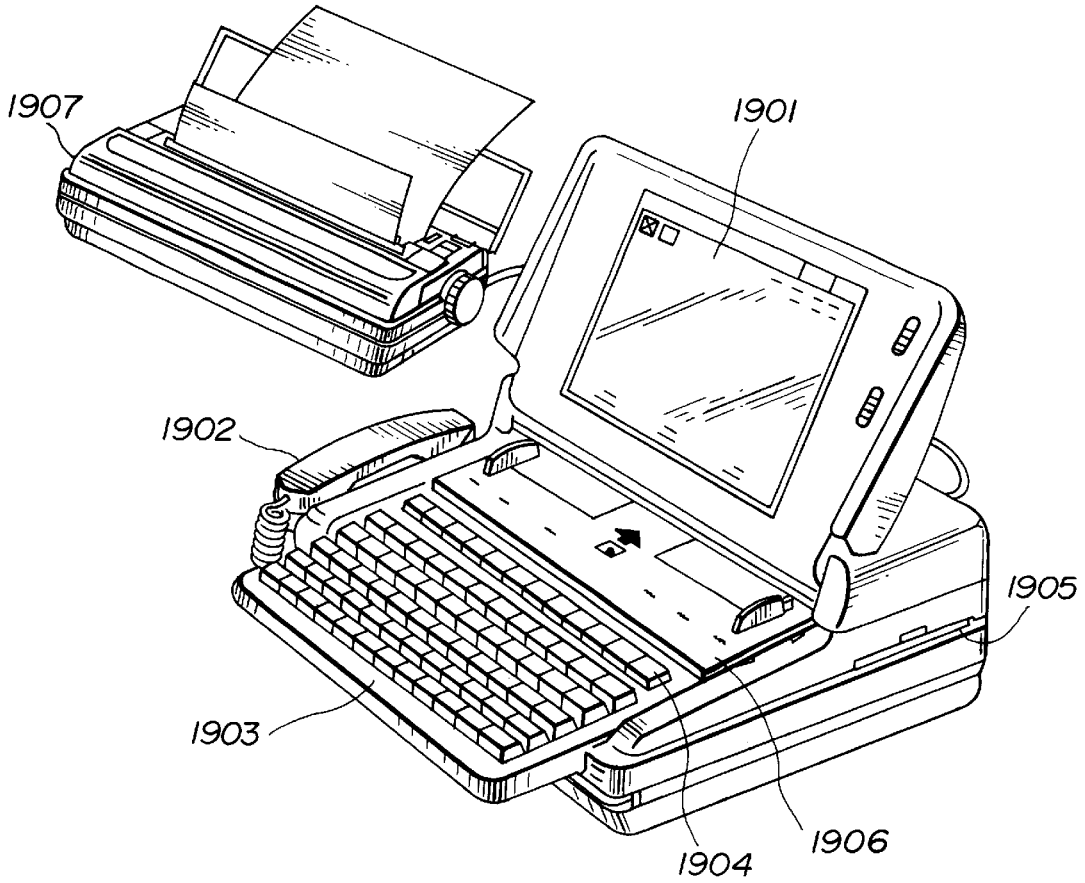
FIG. 19 is a schematic diagram illustrating an external appearance of the information processing apparatus shown in FIG. 18.

FIG. 19 is a schematic diagram illustrating an external appearance of the information processing apparatus shown in FIG. 18.

In FIG. 19, a flat-panel display 1901 comprises a liquid-crystal display or the like, and displays various kinds of menus, graphic information, document information or the like. By depressing the surface of the touch panel 1803 with a finger or the like, coordinates or item assignment can be input on the display 1901. A handset 1902 is used when the apparatus functions as a telephone set. A keyboard 1903 is detachably connected to the main body of the apparatus via a cord, and can be used for inputting various kinds of document information, various kinds of data, and the like. Various kinds of function keys 1904 and the like are provided on the keyboard 1903. Reference numeral 1905 represents an insertion slot for a floppy disk for the external storage device 1812.

Reference numeral 1906 represents a sheet-mounting unit for mounting an original to be read by the image reader unit 1807. The read original is discharged behind the apparatus. In facsimile reception or the like, received data is printed by an ink-jet printer 1907.

Although the display unit 1802 may comprise a CRT (cathode-ray tube), a flat panel, such as a liquid-crystal display utilizing ferroelectric liquid crystal, or the like, is preferable for the display unit 1802, because reduction in the weight of the display can be realized in addition to reduction in the size and the thickness of the display.

When utilizing the above-described information processing apparatus as a personal computer or a word processor, various kinds of information input from the keyboard unit 1811 are processed by the control unit 1801 according to a predetermined program, and the processed result is output from the printer unit 1806 as an image.

When utilizing the information processing apparatus as a receiver of a facsimile apparatus, facsimile information input from the FAX transmission/reception unit 1808 via a communication network is processed by the control unit 1801 according to a predetermined program, and the processed result is output from the printer unit 1806 as a received image.

When utilizing the information processing apparatus as a copier, an original is read by the image reader unit 1807, and data of the read original is output from the printer unit 1806 via the control unit 1801 as a copied image. When utilizing the information processing apparatus as a transmitter of the facsimile apparatus, data of an original read by the image reader unit 1807 is subjected to transmission processing by the control unit 1801 according to a predetermined program, and the processed data is transmitted to the communication network via the FAX transmission/reception unit 1808.

Figure 20:
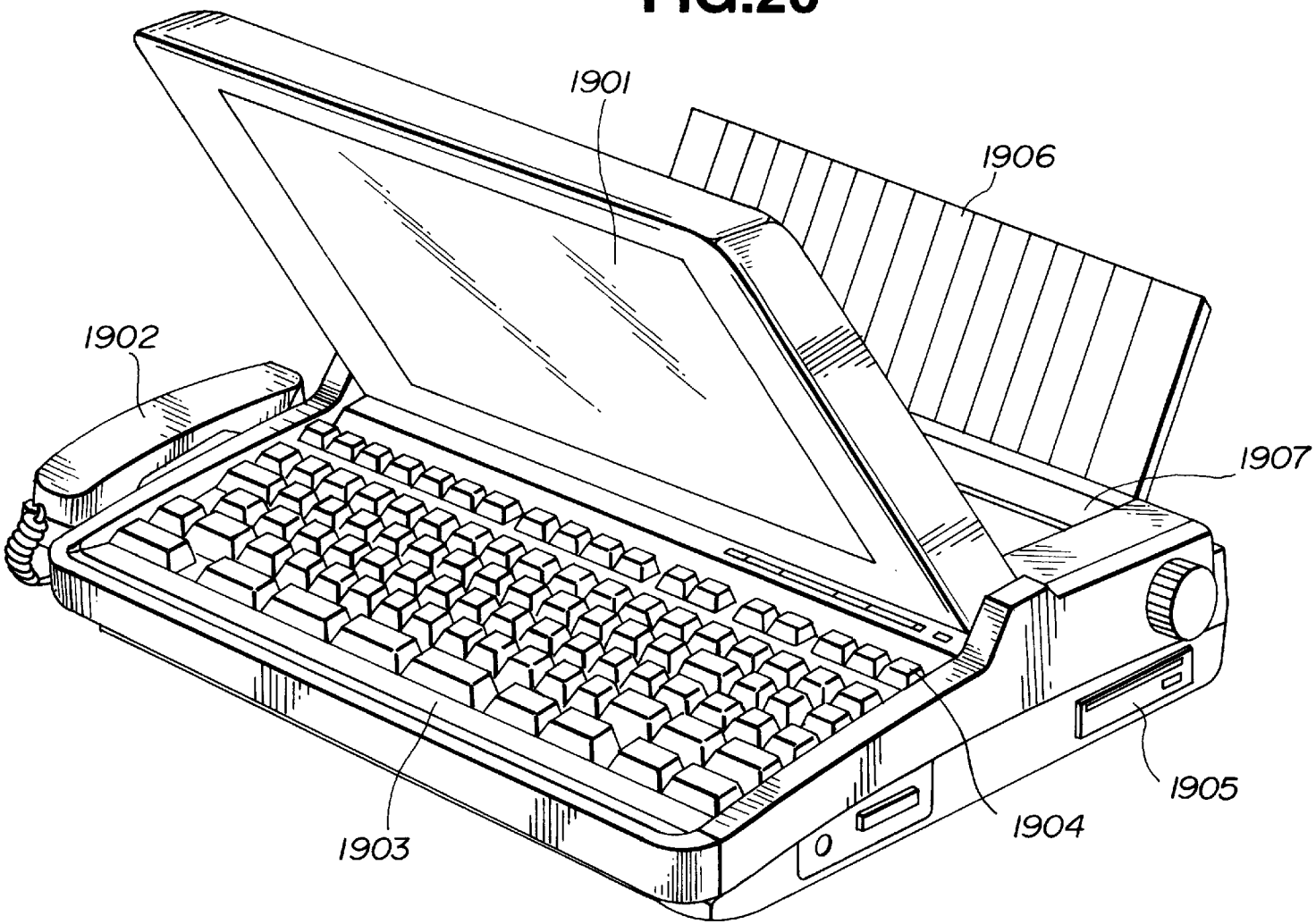
FIG. 20 is a schematic diagram illustrating an external appearance when the printing apparatus of the present invention is applied to the information processing apparatus.

The information processing apparatus may incorporate an ink-jet printer as shown in FIG. 20. In this case, portability of the apparatus can be improved. In FIG. 20, units having the same functions as those shown in FIG. 19 are indicated by the same reference numerals.

By applying the printing apparatus of the present invention to the above-described multifunctional information processing apparatus, it is possible to obtain a high-quality printed image at a high speed with low noise, and therefore to improve the functions of the information processing apparatus.

The individual components shown in outline or designated by blocks in the drawings are all well known in the ink-jet recording arts and their specific construction and operation are not critical to the operation or the best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet recording apparatus for performing recording on a recording medium using an ink jet recording head for discharging ink and a liquid jet head for discharging a processing liquid for causing a coloring material in the ink discharged from the ink jet recording head to be insoluble or to agglomerate, said apparatus comprising:

low-resolution-mode control means for effecting recording at a first resolution by controlling ink discharge from the ink jet recording head to form a plurality of dots on the recording medium by the ink discharged from the ink jet recording head and controlling feeding of the recording medium; and high-resolution-mode control means for effecting recording at a second resolution higher than the first resolution by controlling ink discharge from the ink jet recording head and processing liquid discharge from the liquid jet head to form a plurality of dots by mixing the ink and the processing liquid discharged from the ink jet recording head and the liquid jet head, respectively, on the recording medium and controlling feeding of the recording medium, wherein the coloring material in the ink discharged from the ink jet recording head becomes insoluble or agglomerates when the ink and the processing liquid are mixed on the recording medium.

2. An ink-jet recording apparatus according to claim 1, wherein the processing liquid comprises a cationic substance comprising a low-molecular component and a high-molecular component, and wherein the ink comprises a anionic dye as the coloring material.

3. An ink-jet recording apparatus according to claim 1, wherein the processing liquid comprises a cationic substance comprising a low-molecular component and a high-molecular component, and wherein the ink comprises an anionic compound and a pigment as the coloring material.

4. An ink-jet recording apparatus according to claim 1, wherein the ink jet recording head comprises an energy generating member for generating energy to discharge the ink.

5. An ink-jet recording apparatus according to claim 1, wherein the liquid jet head comprises an energy generating member for generating energy to discharge the processing liquid.

6. An ink-jet recording apparatus according to claim 1, wherein said high-resolution-mode control means controls the processing liquid discharge to occur before the ink discharge on the recording medium.

7. An ink-jet recording apparatus according to claim 1, wherein said high-resolution-mode control means controls the liquid jet head to discharge the processing liquid to form dots of a smaller size than dots formed by ink discharged from the ink recording head.

8. An ink-jet recording apparatus for performing recording on a recording medium using an ink jet recording head for discharging ink and a liquid jet head for discharging a processing liquid for causing a coloring material in the ink discharged from the ink jet recording head to be insoluble or to agglomerate, said apparatus comprising:

low-resolution-mode control means for effecting recording at a first resolution by controlling ink discharge from the ink jet recording head to form a plurality of dots on the recording medium by the ink discharged from the ink jet recording head and controlling feeding of the recording medium; and high-resolution-mode control means for effecting recording at a second resolution higher than the first resolution by controlling ink discharge from the ink jet recording head and processing liquid discharge from the liquid jet head to form a plurality of dots by mixing the ink and the processing liquid discharged from the ink jet recording head and the liquid jet head, respectively, on the recording medium and controlling feeding of the recording medium, wherein the ink jet recording head comprises a plurality of nozzles arranged at a predetermined pitch and said low-resolution-mode control means controls the ink jet recording head to discharge ink at the predetermined pitch, whereas said high-resolution-mode control means controls the ink jet recording head to discharge ink at one-half the predetermined pitch.

9. An ink-jet recording apparatus for performing recording on a recording medium using an ink jet recording head for discharging ink and a liquid jet head for discharging a processing liquid for causing a coloring material in the ink discharged from the ink jet recording head to be insoluble or to agglomerate, said apparatus comprising:

low-resolution-mode control means for effecting recording at a first resolution by controlling ink discharge from the ink jet recording head to form a plurality of dots on the recording medium by the ink discharged from the ink jet recording head and controlling feeding of the recording medium; and high-resolution-mode control means for effecting recording at a second resolution higher than the first resolution by controlling ink discharge from the ink jet recording head and processing liquid discharge from the liquid jet head to form a plurality of dots by mixing the ink and the processing liquid discharged from the ink jet recording head and the liquid jet head, respectively, on the recording medium and controlling feeding of the recording medium, wherein the ink jet recording head comprises a plurality of nozzles arranged at a predetermined pitch and said low-resolution-mode control means controls the ink jet recording head to discharge ink at twice the predetermined pitch, whereas said high-resolution-mode control means controls the ink jet recording head to discharge ink at the predetermined pitch.

10. A recording apparatus comprising:

conveying means for conveying a recording medium;

means for discharging ink onto the recording medium;

means for discharging a processing liquid onto the recording medium, the processing liquid for causing a coloring material in the ink to be insoluble or to agglomerate; and control means for effecting recording in a first mode at a first resolution by controlling ink discharge from said ink discharging means to form a plurality of dots on the recording medium and controlling feeding of the recording medium by said conveying means, and for effecting recording in a second mode at a second resolution higher than the first resolution by controlling ink discharge from said ink discharging means and processing liquid discharge from said processing liquid discharging means to form a plurality of dots by mixing the ink and the processing liquid on the recording medium and controlling feeding of the recording medium by said conveying means, wherein the coloring material in the ink discharged from the ink discharging means becomes insoluble or agglomerates when the ink and the processing liquid are mixed on the recording medium.

11. A recording apparatus according to claim 10, wherein the processing liquid comprises a cationic substance comprising a low-molecular component and a high-molecular component, and wherein the ink comprises a anionic dye as the coloring material.

12. A recording apparatus according to claim 10, wherein the processing liquid comprises a cationic substance comprising a low-molecular component and a high-molecular component, and wherein the ink comprises an anionic compound and a pigment as the coloring material.

13. A recording apparatus according to claim 10, wherein said ink discharging means comprises an energy generating member for generating energy to discharge the ink.

14. A recording apparatus according to claim 10, wherein said processing discharging means comprises an energy generating member for generating energy to discharge the processing liquid.

15. A recording apparatus according to claim 10, wherein in the second mode, said control means controls said processing liquid discharge means to discharge processing liquid before said ink discharging means discharges the ink on the recording medium.

16. A recording apparatus according to claim 10, wherein said control means controls said processing liquid discharging means to discharge the processing liquid to form dots of a smaller size than dots formed by ink discharged from said ink discharging means.

17. A recording apparatus comprising:

conveying means for conveying a recording medium;

means for discharging ink onto the recording medium;

means for discharging a processing liquid onto the recording medium, the processing liquid for causing a coloring material in the ink to be insoluble or to agglomerate; and control means for effecting recording in a first mode at a first resolution by controlling ink discharge from said ink discharging means to form a plurality of dots on the recording medium and controlling feeding of the recording medium by said conveying means, and for effecting recording in a second mode at a second resolution higher than the first resolution by controlling ink discharge from said ink discharging means and processing liquid discharge from said processing liquid discharging means to form a plurality of dots by mixing the ink and the processing liquid on the recording medium and controlling feeding of the recording medium by said conveying means, wherein said ink discharging means comprises a plurality of nozzles arranged at a predetermined pitch and in the first mode said control means controls said ink jet discharging means to discharge ink at the predetermined pitch, whereas in the second mode said control means controls said ink discharging means to discharge ink at one-half the predetermined pitch.

18. A recording apparatus comprising:

conveying means for conveying a recording medium;

means for discharging ink onto the recording medium;

means for discharging a processing liquid onto the recording medium, the processing liquid for causing a coloring material in the ink to be insoluble or to agglomerate; and control means for effecting recording in a first mode at a first resolution by controlling ink discharge from said ink discharging means to form a plurality of dots on the recording medium and controlling feeding of the recording medium by said conveying means, and for effecting recording in a second mode at a second resolution higher than the first resolution by controlling ink discharge from said ink discharging means and processing liquid discharge from said processing liquid discharging means to form a plurality of dots by mixing the ink and the processing liquid on the recording medium and controlling feeding of the recording medium by said conveying means, wherein said ink discharging means comprises a plurality of nozzles arranged at a predetermined pitch and in the first mode said control means controls said ink jet discharging means to discharge ink at twice the predetermined pitch, whereas in the second mode said control means controls said ink discharging means to discharge ink at the predetermined pitch.

19. An ink-jet recording method for performing recording on a recording medium using an ink jet recording head for discharging ink and a liquid jet head for discharging a processing liquid for causing a coloring material in the ink discharged from the ink jet recording head to be insoluble or to agglomerate, said method comprising the steps of:

selectively effecting recording in a low-resolution mode at a first resolution by controlling ink discharge from the ink jet recording head to form a plurality of dots on the recording medium by the ink discharged from the ink jet recording head and controlling feeding of the recording medium; and selectively effecting recording in a high-resolution mode at a second resolution higher than the first resolution by controlling ink discharge from the ink jet recording head and processing liquid discharge from the liquid jet head to form a plurality of dots by mixing the ink and the processing liquid discharged from the ink jet recording head and the liquid jet head, respectively, on the recording medium and controlling feeding of the recording medium, wherein the coloring material in the ink discharged from the ink jet recording head becomes insoluble or agglomerates when the ink and the processing liquid are mixed on the recording medium.

20. An ink-jet recording method according to claim 19, wherein the processing liquid comprises a cationic substance comprising a low-molecular component and a high-molecular component, and wherein the ink comprises a anionic dye as the coloring material.

21. An ink-jet recording method according to claim 19, wherein the processing liquid comprises a cationic substance comprising a low-molecular component and a high-molecular component, and wherein the ink comprises an anionic compound and a pigment as the coloring material.

22. An ink-jet recording method according to claim 19, wherein in said high-resolution-mode recording step, the liquid jet head is controlled to discharge the processing liquid to form dots of a smaller size than dots formed by ink discharged from the ink jet recording head.

23. An ink jet recording method according to claim 19, wherein in the high-resolution mode the processing liquid discharge occurs before the ink discharge on the recording medium.

* * * * *

UNITED STATES PATENT AND TRADEMARK OFFICE

CERTIFICATE OF CORRECTION

PATENT NO. : 5,959,641

DATED : September 28, 1999

INVENTOR(S) : KATSUYUKI YOKOI

It is certified that error appears in the above-identified patent and that said Letters Patent is hereby corrected as shown below:

COLUMN 9:
Between lines 32 and 33, "Y1" should be inserted as a heading.

COLUMN 14:
Line 28, "(Novaperin" should read --(Novaperm--.

COLUMN 19:
Line 40, "a" should read --an--.

COLUMN 21:
Line 14, "a" should read --an--.

COLUMN 22:
Line 51, "a" should read --an--.

Signed and Sealed this

Thirteenth Day of June, 2000

*Attest:*

*Attesting Officer*

Q. TODD DICKINSON

*Director of Patents and Trademarks*